US009927106B2

(12) United States Patent
Hsieh et al.

(10) Patent No.: US 9,927,106 B2
(45) Date of Patent: Mar. 27, 2018

(54) LAMP

(71) Applicant: Radiant Opto-Electronics Corporation, Kaohsiung (TW)

(72) Inventors: Chien-Min Hsieh, Kaohsiung (TW); Chih-Hung Ju, Kaohsiung (TW); Guo-Hao Huang, Kaohsiung (TW)

(73) Assignee: Radiant Opto-Electronics Corporation, Kaohsiung (TW)

( * ) Notice: Subject to any disclaimer, the term of this patent is extended or adjusted under 35 U.S.C. 154(b) by 118 days.

(21) Appl. No.: 15/059,283

(22) Filed: Mar. 2, 2016

(65) Prior Publication Data

US 2016/0265757 A1 Sep. 15, 2016

(30) Foreign Application Priority Data

Mar. 12, 2015 (TW) ..... 104107956 A

(51) Int. Cl.
*F21V 21/30* (2006.01)
*F21V 14/02* (2006.01)

(52) U.S. Cl.
CPC ..... *F21V 21/30* (2013.01); *F21V 14/02* (2013.01)

(58) Field of Classification Search
CPC ..... F21V 21/28; F21V 21/29; F21V 21/30; F21V 14/02
See application file for complete search history.

(56) References Cited

U.S. PATENT DOCUMENTS

| | | | | | |
|---|---|---|---|---|---|
| 5,377,087 | A * | 12/1994 | Yoon | F21V 21/30 | 362/148 |
| 5,404,297 | A * | 4/1995 | Birk | B64D 11/00 | 362/287 |
| 8,733,988 | B2 * | 5/2014 | Huang | F21V 21/30 | 362/269 |
| 9,523,493 | B2 * | 12/2016 | Chen | F21S 8/026 | |
| 2008/0007958 | A1 | 1/2008 | Chen | | |
| 2011/0286227 | A1 | 11/2011 | Dellian et al. | | |
| 2014/0233246 | A1 | 8/2014 | Lafreniere et al. | | |

FOREIGN PATENT DOCUMENTS

| | | | |
|---|---|---|---|
| CN | 2842169 | Y | 11/2006 |
| CN | 201779472 | U | 3/2011 |
| CN | 102301179 | A | 12/2011 |
| CN | 203258604 | U | 10/2013 |
| CN | 103597284 | A | 2/2014 |
| CN | 203671462 | U | 6/2014 |
| EP | 2413018 | A1 | 2/2012 |
| TW | M477965 | U | 5/2014 |

* cited by examiner

*Primary Examiner* — Alan Cariaso
(74) *Attorney, Agent, or Firm* — CKC & Partners Co., Ltd.

(57) ABSTRACT

A lamp includes a rotary adjustment mechanism, an inclination adjustment mechanism and a light source. The light source is rotatable along a first direction in a first plane by the rotary adjustment mechanism and/or rotatable relative along a second direction in a second plane by the inclination adjustment mechanism, wherein the second plane is different from the first plane.

19 Claims, 25 Drawing Sheets

LAMP

RELATED APPLICATIONS

This application claims priority to Taiwan Application Serial Number 104107956, filed Mar. 12, 2015, which is herein incorporated by reference.

BACKGROUND

Field of Invention

The present invention relates to an illuminating device. More particularly, the present invention relates to a lamp.

Description of Related Art

Besides for illumination, a lamp also can be used for creating atmosphere of an interior space. Projecting lamp has a function of adjusting different light emitting directions, and thus many people like to use the projecting lamp to build atmosphere of home or public.

However, adjusting members of the projecting lamps mostly are externally exposed, thereby allowing users to change light emitting directions of the projecting lamps. The externally-exposed adjusting members are likely to be damaged due to long term exposure to the moisture or dust in the ambience. Furthermore, when multiple projecting lamps are used in the same space, if the rotation and light emitting direction of multiple projecting lamps are different from each other, a disordered visual effect in the space will be resulted in.

SUMMARY

One object of the present invention is to provide a lamp having built-in adjusting members. Therefore, when the light emitting direction of the lamp is changed, the exterior appearance of the lamp can be kept unchanged.

According to the aforementioned object, another lamp is provided. The lamp includes a rotary adjustment mechanism, an inclination adjustment mechanism and a light source. The light source is rotatable along a first direction in a first plane by the rotary adjustment mechanism and/or rotatable relative along a second direction in a second plane by the inclination adjustment mechanism, wherein the second plane is different from the first plane.

According to an embodiment of the present invention, the lamp further comprises a lamp base, a case body and a spherical shell. The light source is disposed on the spherical shell. The rotary adjustment mechanism connects the lamp base and the case body, thereby enabling the case body to rotate relative to the lamp base along the first direction in the first plane. The inclination adjustment mechanism connects the case body to the spherical shell, thereby enabling the spherical shell to rotate relative to the case body along the second direction in the second plane.

According to the aforementioned object, another lamp is provided. The lamp includes a lamp base, a case body, a rotary adjustment mechanism, a spherical shell, an inclination adjustment mechanism and a light source. The case body has a first inner space and an opening. The rotary adjustment mechanism connects the lamp base and the case body, thereby enabling the case body to rotate relative to the lamp base along a first direction in a first plane. The spherical shell is partially disposed in the first inner space and partially extends out of the opening. The inclination adjustment mechanism connects the case body to the spherical shell, thereby enabling the spherical shell to rotate relative to the case body along a second direction in a second plane, wherein the second plane is different from the first plane. The light source is disposed on the spherical shell.

According to an embodiment of the present invention, the rotary adjustment mechanism includes at least one first sliding chute and at least one first fixing member. The first sliding chute passes through a bottom portion of the lamp base. The first fixing member is moveably disposed through the first sliding chute and is fixed on the case body.

According to an embodiment of the present invention, the case body has a top portion and at least one convex post extending from the top portion, and the first fixing member is fixed on the convex post.

According to an embodiment of the present invention, the inclination adjustment mechanism includes at least one second sliding chute, at least one sliding member and at least one second fixing member. The second sliding chute is disposed at the case body. The sliding member slidably is disposed in the second sliding chute. The fixing member is correspondingly disposed through the sliding member and the second sliding chute and is fixed on the spherical shell.

According to an embodiment of the present invention, the sliding member is a resilient pad.

According to an embodiment of the present invention, the positioning ring is disposed between the lamp base and the case body.

According to an embodiment of the present invention, the lamp base includes a bottom portion has a top surface and a bottom surface opposite to each other. The rotary adjustment mechanism includes a connecting member and a retaining ring. The connecting member is fixed on the case body, in which the connecting member includes a bottom base and a convex portion disposed on the bottom base, and the convex portion is disposed through the bottom portion of the lamp base and the bottom base abuts against the bottom surface of the bottom portion. The retaining ring is disposed on the convex portion of the connecting member and abuts against the top surface of the bottom portion.

According to an embodiment of the present invention, a sliding chute is disposed on the bottom surface of the bottom portion. The case body has a top portion and a convex post extending from the top portion, in which the convex post is movably disposed in the sliding chute.

According to an embodiment of the present invention, a width of the sliding chute of the bottom surface is getting narrower to form a stopper on the bottom surface of the bottom portion According to an embodiment of the present invention, the rotary adjustment mechanism further includes a positioning ring. A recess is disposed on the bottom surface of the bottom portion, in which the positioning ring is disposed in the recess and abuts against the bottom base of the connecting member.

According to an embodiment of the present invention, the spherical shell further includes a second inner space. The inclination adjustment mechanism includes a swing base, a pivot mechanism and a connecting stem. The swing base is disposed in the second inner space and is connected to the spherical shell. The pivot mechanism is connected to the swing base. One end of the connecting stem is pivoted on the swing base, and the other end of the connecting stem penetrates the spherical shell and is fixed on a top portion of the case body.

According to an embodiment of the present invention, a groove is disposed on the case body. The inclination adjustment mechanism further includes an adjusting member. The adjusting member is disposed through the groove from outside of the case body and is connected to the spherical shell, so that the spherical shell is swingable relative to the connecting stem.

According to an embodiment of the present invention, the spherical shell includes an upper spherical shell, a lower spherical shell and at least one fixing member. The upper spherical shell has at least one connecting post and at least one post opening. The lower spherical shell has at least one supporting post corresponding to the connecting post. The fixing member penetrates through the connecting post from the post opening of the upper spherical shell and is fixed on the supporting post of the lower spherical shell.

According to an embodiment of the present invention, the lamp base includes a bottom portion. The bottom portion has a top surface. The case body includes a top plate having a bottom surface. The rotary adjustment mechanism includes a connecting member and a retaining ring. The connecting member is fixed on the case body, in which the connecting member includes a bottom base and a convex portion disposed on the bottom base. The convex portion penetrates through the top plate of the case body and the bottom portion of the lamp base, and the bottom base abuts against the bottom surface of the top plate. The retaining ring is disposed on the convex portion of the connecting member and abuts against the top surface of the lamp base.

According to an embodiment of the present invention, the bottom portion of the lamp base further includes a bottom surface, in which a sliding chute is disposed on the bottom surface of the bottom portion. The case body has a convex post extending from the top plate of the case body, in which the convex post is movably disposed in the sliding chute.

According to an embodiment of the present invention, a width of the sliding chute of the bottom surface is getting narrower to form a stopper on the bottom surface of the bottom portion.

According to an embodiment of the present invention, the rotary adjustment mechanism further includes a positioning ring. A recess is disposed on the bottom surface of the bottom portion, in which the positioning ring is disposed in the recess and is mounted on the convex portion of the connecting member.

According to an embodiment of the present invention, the case body further includes a partition plate. An accommodating space is formed between the partition plate and the top plate. The inclination adjustment mechanism includes an adjusting member, a sliding block and a connecting rod. The adjusting member is disposed in the accommodating space. A threaded rod is connected to the adjusting member, in which the adjusting member rotates with the threaded rod. The sliding block is slidably disposed on the threaded rod. Two ends of the connecting rod are respectively pivoted on the sliding block and the spherical shell.

According to an embodiment of the present invention, the case body further includes a window, in which the position of the window is corresponding to the position of the adjusting member.

According to the above embodiments, the lamp of the present invention includes the rotary adjustment mechanism and the inclination adjustment mechanism, thereby enabling a user to rotate the case body relative to the lamp base or to rotate the spherical shell relative to the case body, thus changing a light emitting direction of the lamp to meet different illumination requirements. In addition, the rotary adjustment mechanism and the inclination adjustment mechanism are hidden internally, so that the exterior appearance of the lamp can be kept unchanged when the light emitting direction of the lamp is changed. Therefore, when multiple lamps with different light emitting directions are applied in the same space, each lamp has the same exterior appearance to make the visual effect in the space look more simple and organized.

It is to be understood that both the foregoing general description and the following detailed description are depicted by examples, and are intended to provide further explanations as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
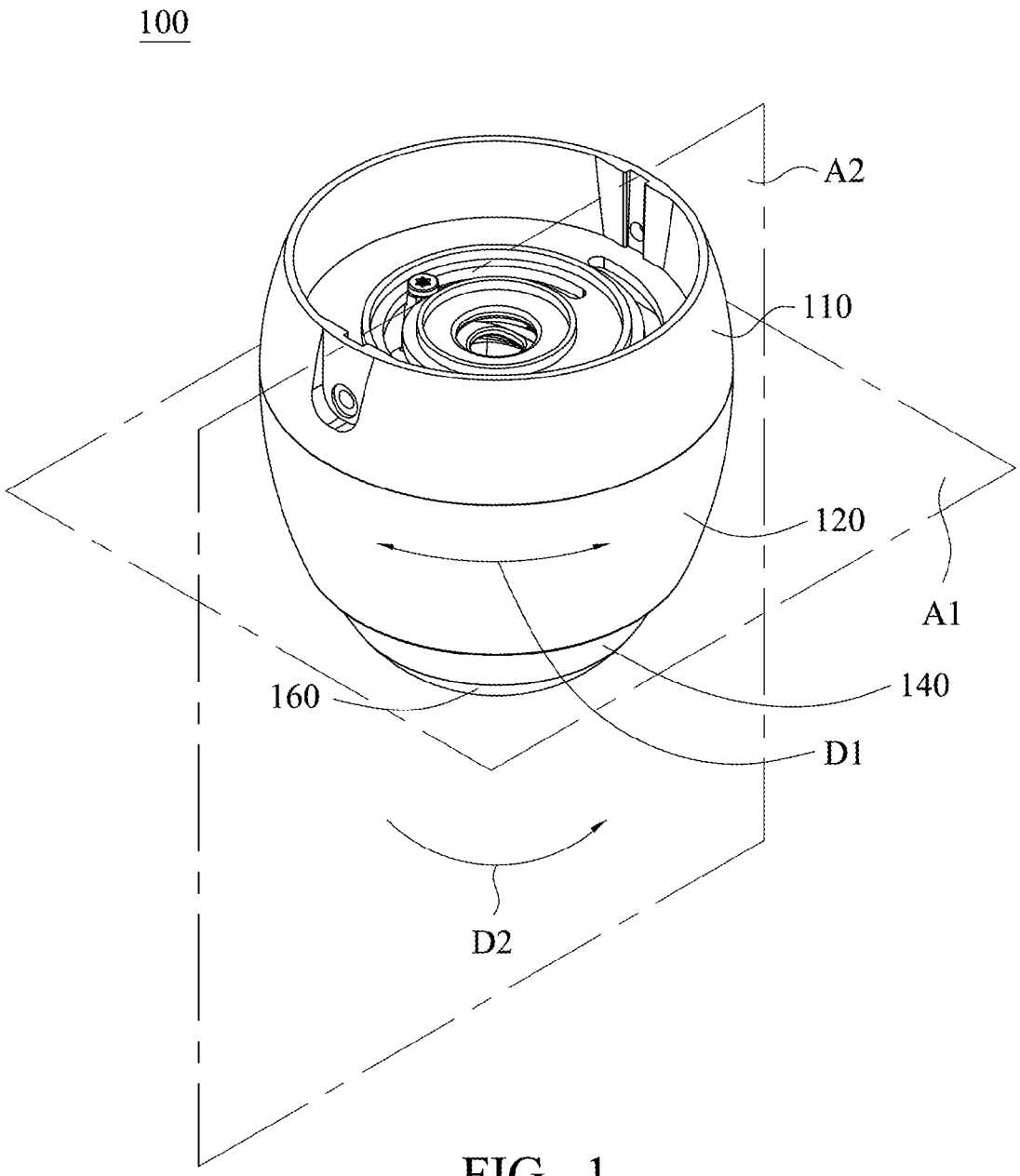
FIG. 1 is a schematic diagram showing a lamp in accordance with a first embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
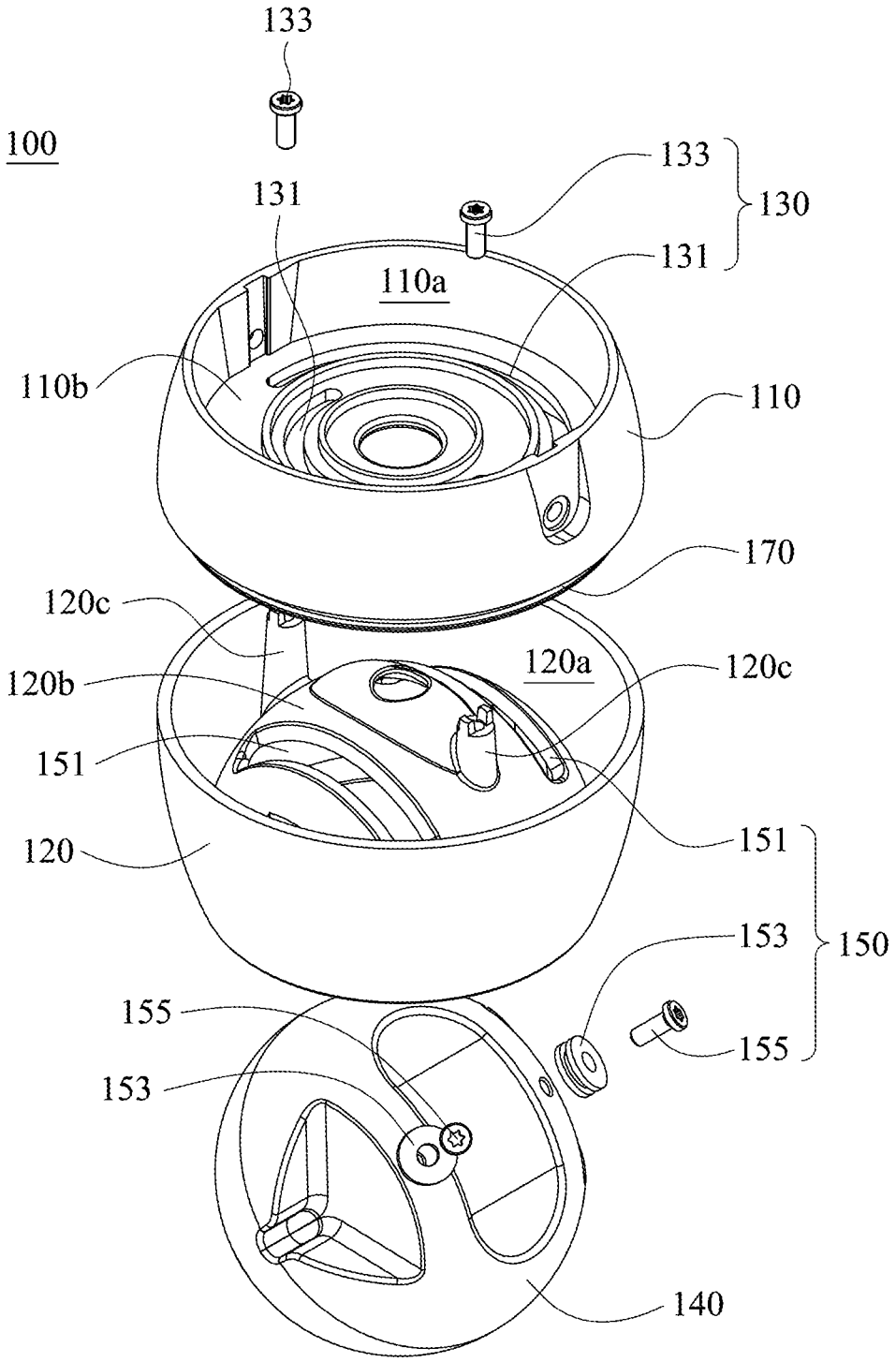
FIG. 2 is a schematic exploded view showing the lamp in accordance with the first embodiment of the present invention.

Simultaneously referring to FIG. 1 and FIG. 2, FIG. 1 and FIG. 2 are a schematic diagram and a schematic exploded view showing a lamp 100 in accordance with a first embodiment of the present invention. The lamp 100 mainly includes a rotary adjustment mechanism 130, an inclination adjustment mechanism 150 and a light source 160. As shown in FIG. 1, the light source 160 is rotatable along a first direction D1 in a first plane A1 by the rotary adjustment mechanism 130 and/or rotatable relative along a second direction D2 in a second plane A2 by the inclination adjustment mechanism 150. In the present embodiment, the second plane A2 is different from the first plane A1. As shown in FIG. 1 and FIG. 2, the lamp 100 further includes a lamp base 110, a case body 120 and a spherical shell 140. The rotary adjustment mechanism 130 is disposed in an inner space 110*a* of the lamp base 110 and/or an inner space 120*a* of the case body 120, and the rotary adjustment mechanism 130 can be used to connect the lamp base 110 and the case body 120, so as to enable the case body 120 to rotate relative to the lamp base 110 along the first direction D1 in the first plane A1. The inclination adjustment mechanism 150 is disposed in the inner space 120*a* of the case body 120 and can be used to connect the case body 120 and the spherical shell 140, so as to enable the spherical shell 140 to rotate relative to the case body 120 along the second direction D2 in the second plane A2. Moreover, the light source 160 is disposed on the spherical shell 140, so that light emitting direction of the light source 160 can be changed by adjusting the rotary adjustment mechanism 130 and the inclination adjustment mechanism 150. As shown in FIG. 1, the first plane A1 and the second plane A2 are imaginary planes, and the first plane A1 is different from the second plane A2. In one embodiment, the first plane A1 is perpendicular to the second plane A2.

Figure 3A:
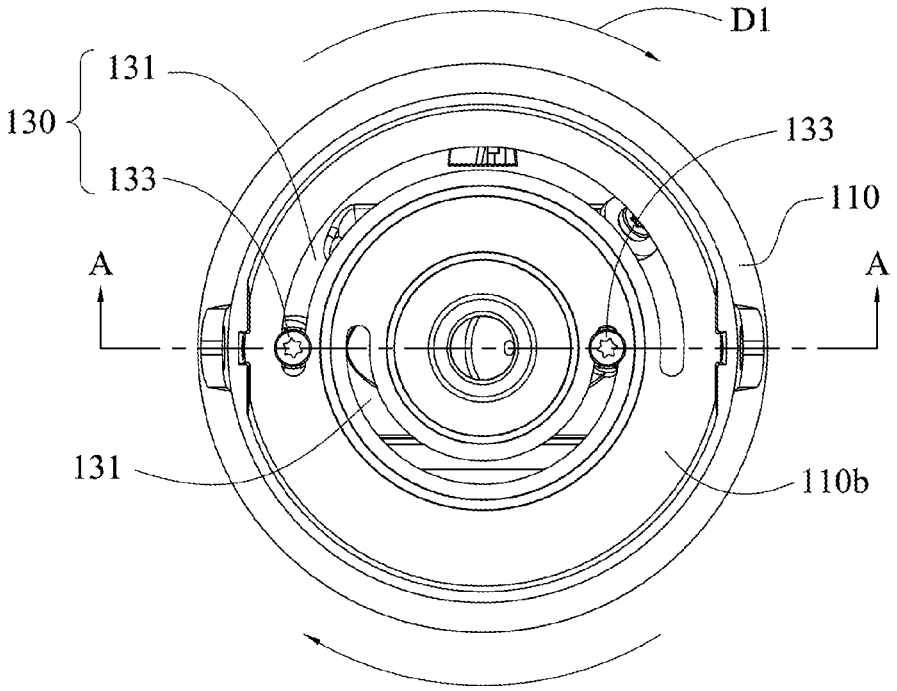
FIG. 3A is a schematic top view showing a case body at a starting position in accordance with the first embodiment of the present invention.
Figure 3B:
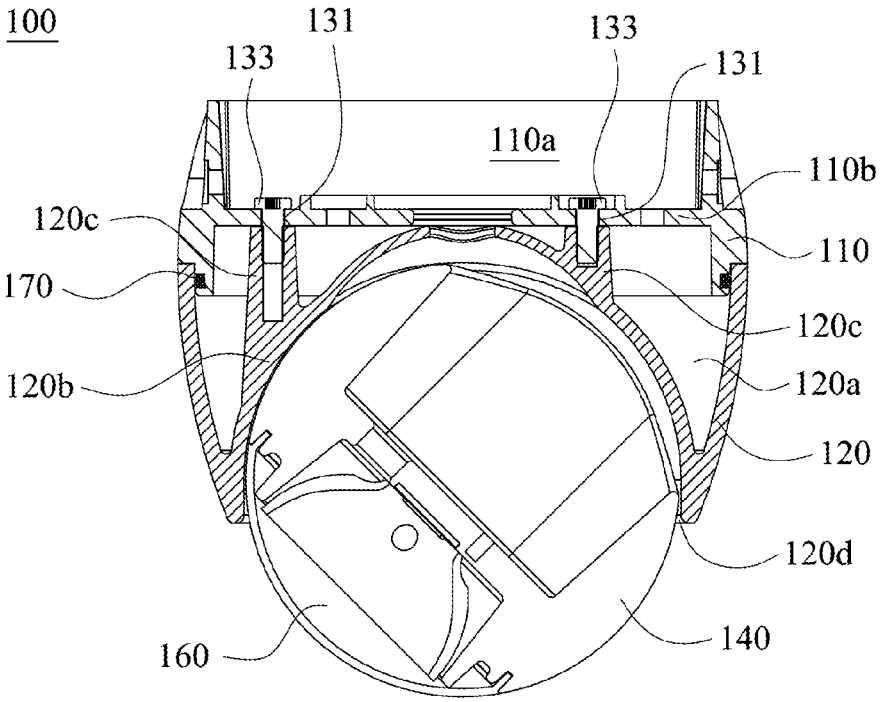
FIG. 3B is a schematic cross-sectional view taken along a line A-A in FIG. 3A.

Simultaneously referring to FIG. 1, FIG. 2, FIG. 3A and FIG. 3B, FIG. 3A is a schematic top view showing the case body 120 at a starting position in accordance with the first embodiment of the present invention, and FIG. 3B is a schematic cross-sectional view taken along a line A-A in FIG. 3A. In the present embodiment, the rotary adjustment mechanism 130 includes at least one first sliding chute 131 and at least one first fixing member 133. The first sliding chute 131 penetrates a bottom portion 110*b* of the lamp base 110. In one embodiment, the first sliding chute 131 is semicircle arc shaped, but not limited thereto. Moreover, the first sliding chute 131 extends along the first direction D1. The first fixing member 133 is disposed through the first sliding chute 131 and is fixed on the case body 120.

As shown in FIG. 2 and FIG. 3B, in other embodiments, the case body 120 has a top portion 120*b*, at least one convex post 120*c* and an opening 120*d*. The convex post 120*c* extends from the top portion 120*b*. The number and the position of the convex post 120*c* is corresponding to that of the first fixing member 133. The first fixing member 133 is disposed through the first sliding chute 131 and is fixed on the convex post 120*c* of the case body 120. Therefore, when the case body 120 is rotated relative to the lamp base 110 along the first direction D1, the first fixing member 133 slides in the first sliding chute 131. In one embodiment, a positioning ring 170 can be disposed between the case body 120 and the lamp base 110. The positioning ring 170 is used to increase the friction between the case body 120 and the lamp base 110, so as to ensure that the case body 120 can be positioned at a precise position. In one example, the positioning ring 170 can be an O-ring.

Figure 4A:
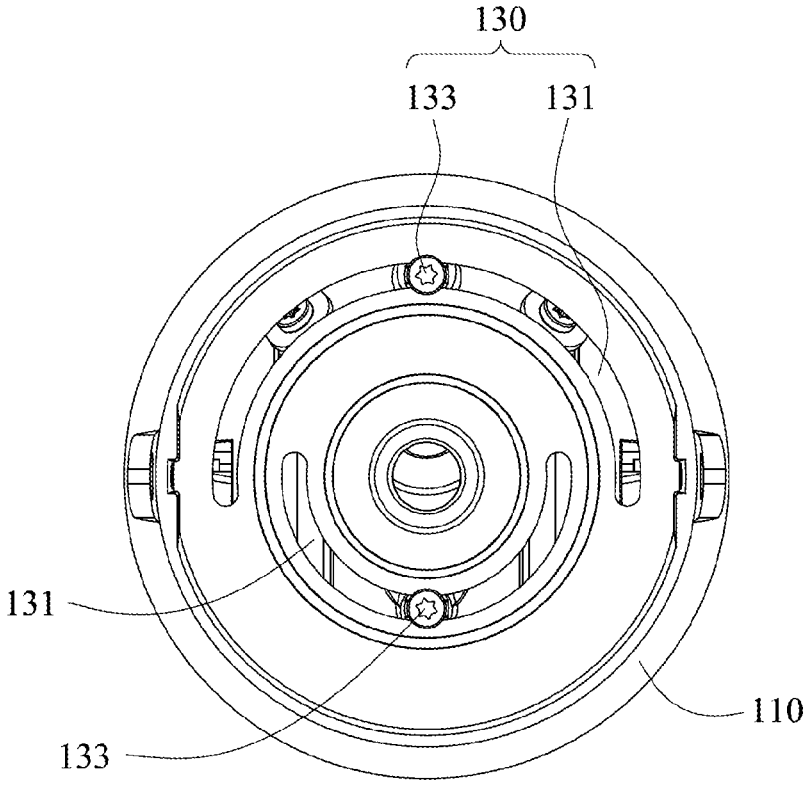
FIG. 4A and FIG. 4B are schematic diagrams showing the case body being rotated 90 degrees along a first direction.
Figure 4B:
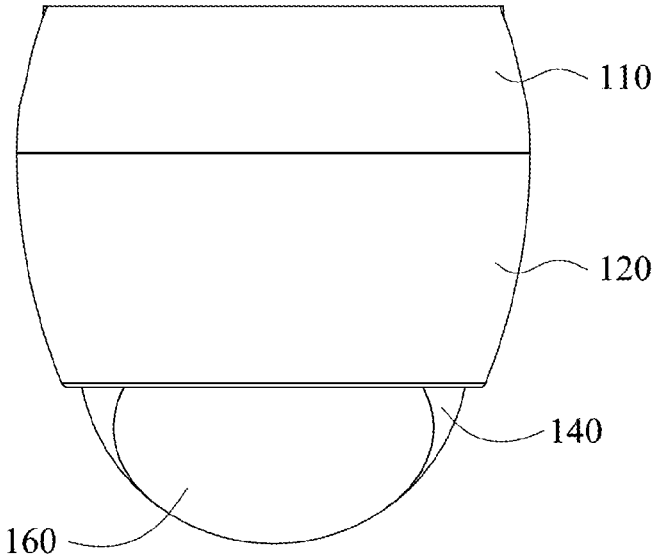

Simultaneously referring to FIG. 3A-FIG. 4B, in which FIG. 4A and FIG. 4B are schematic diagrams showing the case body 120 being rotated 90 degrees along the first direction D1. As shown in FIG. 3A and FIG. 3B, the case body 120 is at a starting position, and the first fixing member 133 is at one end of the first sliding chute 131. As shown in FIG. 4A and FIG. 4B, when the case body 120 is rotated 90 degrees relative to the lamp base 110 along the first direction D1, the light emitting direction of the light source 160 rotates 90 degrees along with the case body 120, and the first fixing member 133 moves to a middle position of the first sliding chute 131 accordingly.

Figure 5A:
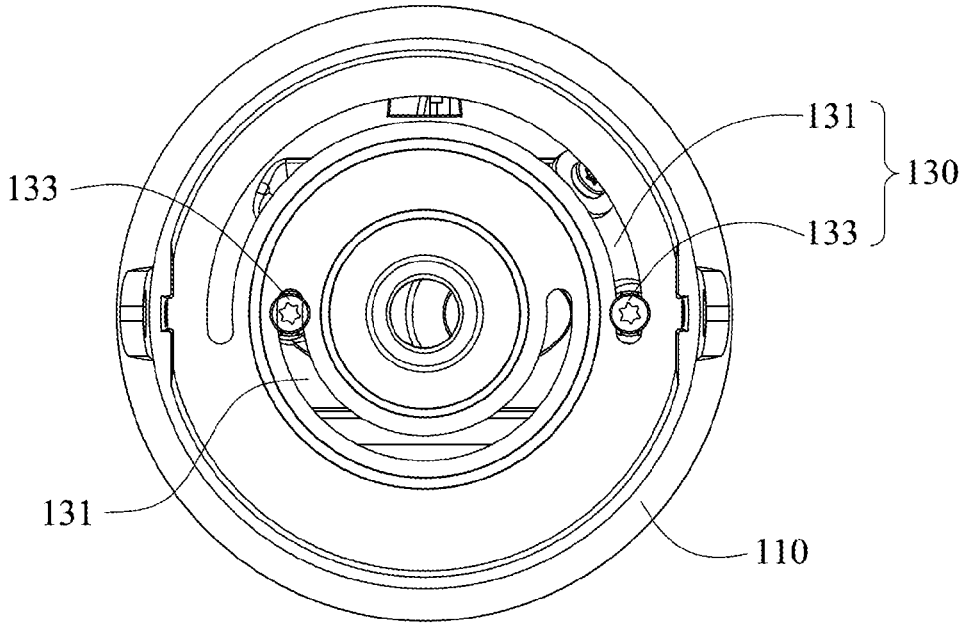
FIG. 5A and FIG. 5B are schematic diagrams showing the case body being rotated 180 degrees along the first direction.
Figure 5B:
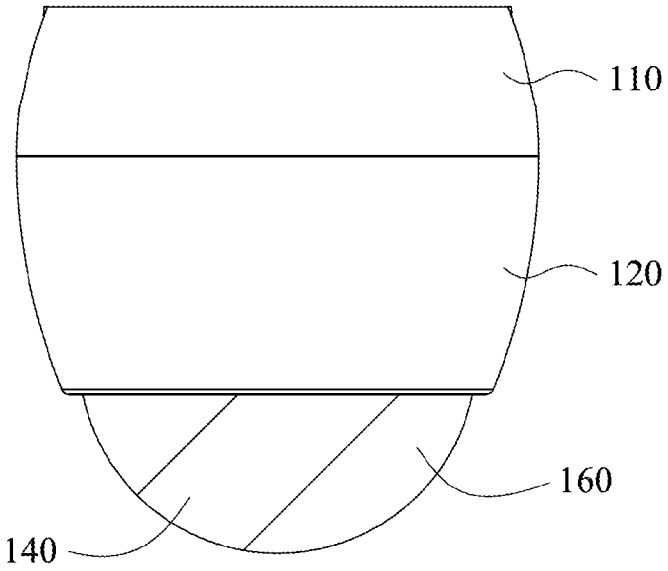

Referring to FIG. 5A and FIG. 5B, FIG. 5A and FIG. 5B are schematic diagrams showing the case body 120 being rotated 180 degrees along the first direction D1. When the case body 120 is rotated 180 degrees relative to the lamp base 110 along the first direction D1, the light emitting direction of the light source 160 rotates 180 degrees along with the case body 120, and the first fixing member 133 moves to the other end of the first sliding chute 131 accordingly. Therefore, the light emitting direction of the light source 160 can be changed by rotating the case body 120. It is noted that, the rotation angle of the case body 120 is related to the extending arc-length of the first sliding chute 131. Therefore, in other embodiments, the extending arc-length of the first sliding chute 131 can be designed according to rotation angles required by the case body 120, so as to meet practical requirements.

Figure 6:
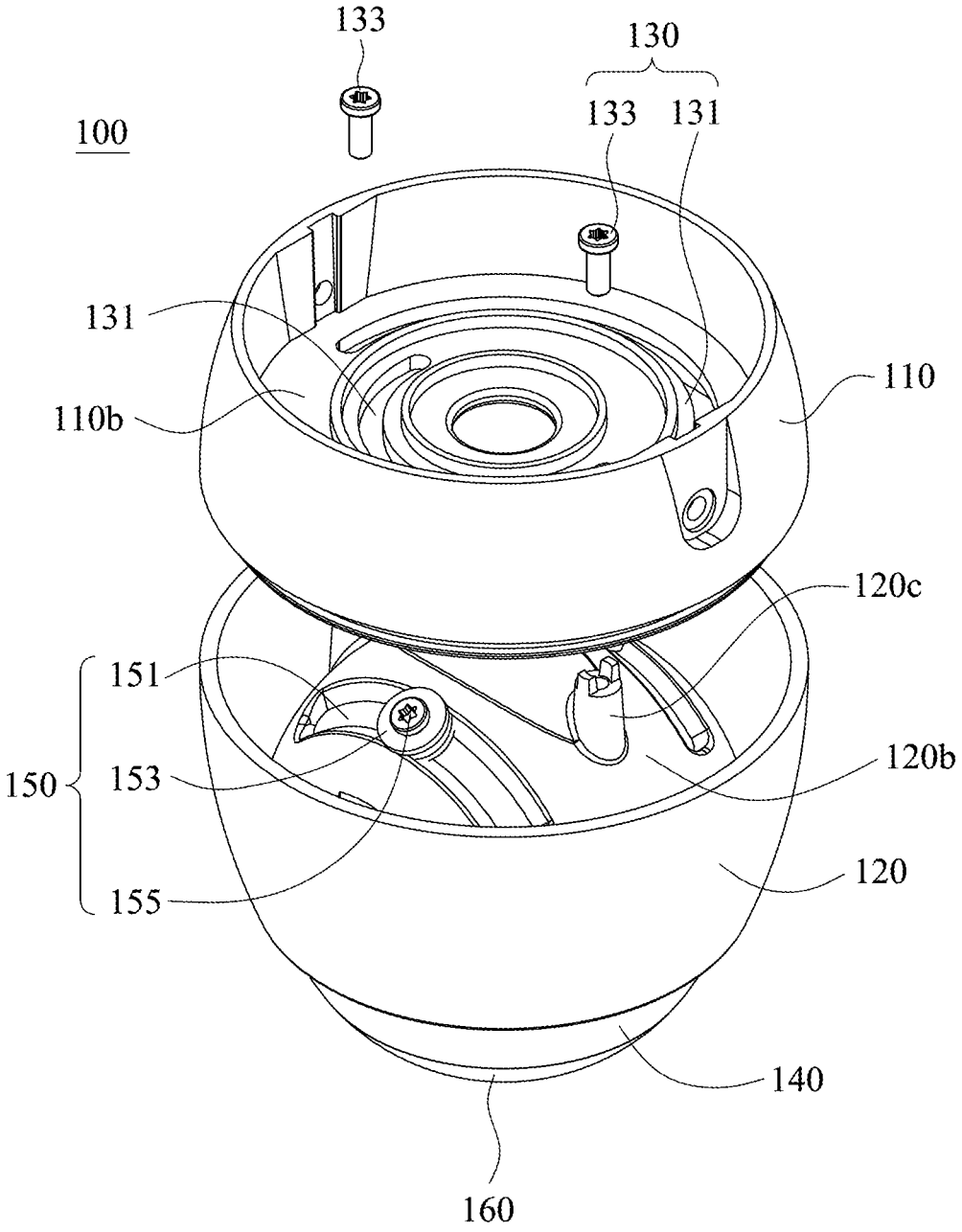
FIG. 6 is another schematic exploded view showing the lamp in accordance with the first embodiment of the present invention.
Figure 7A:
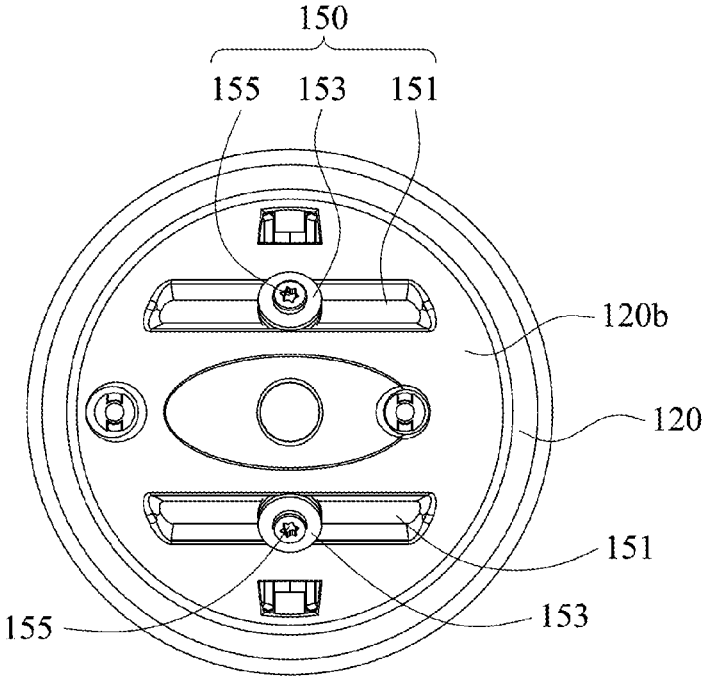
FIG. 7A is a schematic top view showing a spherical shell at a starting position in accordance with the first embodiment of the present invention.
Figure 7B:
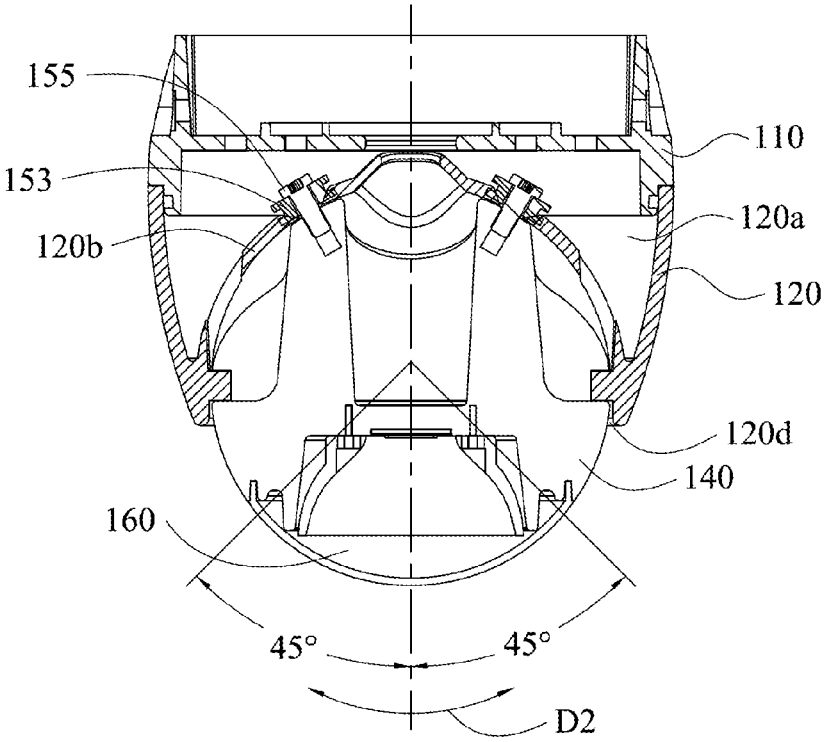
FIG. 7B is another schematic cross-sectional view showing the spherical shell at the starting position.

Simultaneously referring to FIG. 2, FIG. 6, FIG. 7A and FIG. 7B, in which FIG. 6 is another schematic exploded view showing the lamp 100 in accordance with the first embodiment of the present invention, and FIG. 7A and FIG. 7B are a schematic top view and a schematic cross-sectional view showing the spherical shell 140 at a starting position in accordance with the first embodiment of the present invention. It is noted that, in order to clearly illustrate the structures of the case body 120 and the spherical shell 140, the lamp base 110 is not illustrated in FIG. 7A. In the present embodiment, the inclination adjustment mechanism 150 includes at least one at least one second sliding chute 151, at least one sliding member 153 and at least one second fixing member 155. The second sliding chute 151 is disposed at the top portion 120*b* of the case body 120. In one embodiment, the top portion 120*b* of the case body 120 is corresponding to the arc shape of the spherical shell 140. In addition, the second sliding chute 151 extends along the second direction D2, and the shape of the second sliding chute 151 is corresponding to that of the top portion 120*b*. The sliding member 153 is slidably disposed in the second sliding chute 151. The second fixing member 155 is correspondingly disposed through the sliding member 153 and the second sliding chute 151 and is fixed to the spherical shell 140. Therefore, when the spherical shell 140 is rotated relative to the case body 120 along the second direction D2, the sliding member 153 slides in the second sliding chute 151 accordingly.

In one embodiment, the sliding member 153 has elasticity itself, and the friction between the sliding member 153 and the second sliding chute 151 enables that the spherical shell 140 can be positioned at a precise position after being rotated. In one example, the sliding member 153 is a resilient pad.

Figure 8A:
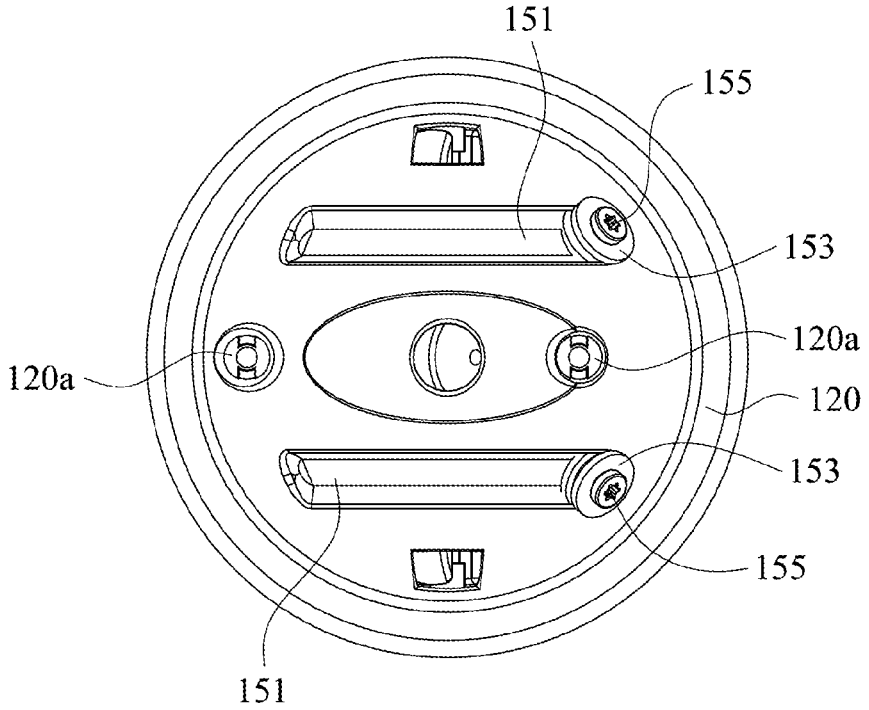
FIG. 8A and FIG. 8B are schematic diagrams showing the spherical shell being rotated clockwise 45 degrees along a second direction.
Figure 8B:
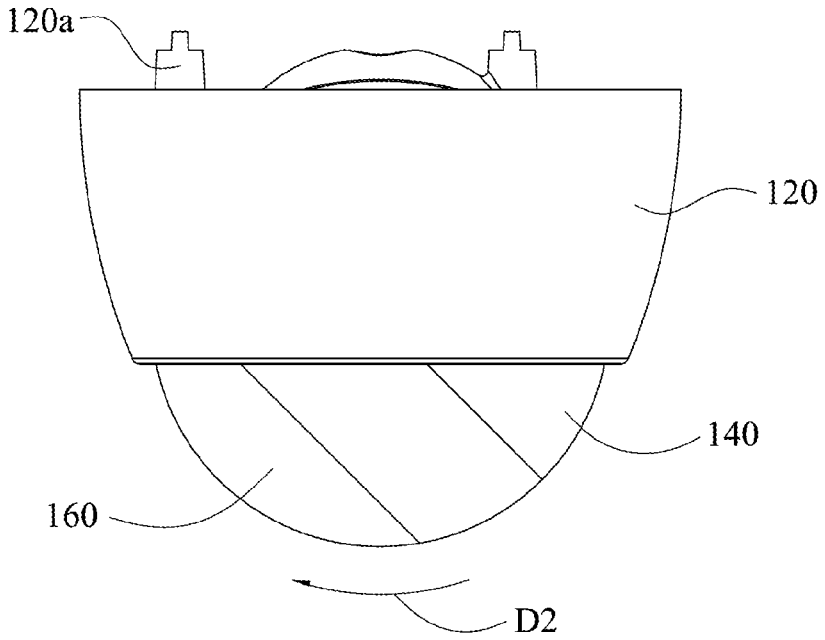

Simultaneously referring to FIG. 7A to FIG. 8B, in which FIG. 8A and FIG. 8B are schematic diagrams showing the spherical shell 140 being rotated clockwise 45 degrees along the second direction D2. It is noted that, in order to clearly illustrate the rotation of spherical shell 140, the lamp base 110 is not illustrated in FIG. 8A and FIG. 8B. As shown in FIG. 7A and FIG. 7B, the spherical shell 140 is at a starting position, and the sliding member 153 and the second fixing member 155 are at a middle position of the second sliding chute 151. As shown in FIG. 8A and FIG. 8B, when the spherical shell 140 is rotated clockwise 45 degrees relative to the case body 120 along the second direction D2 from the starting position, the light emitting direction of the light source 160 rotates clockwise 45 degrees along with the spherical shell 140, and the sliding member 153 and the second fixing member 155 moves to one end of the second sliding chute 151 accordingly.

Figure 9A:
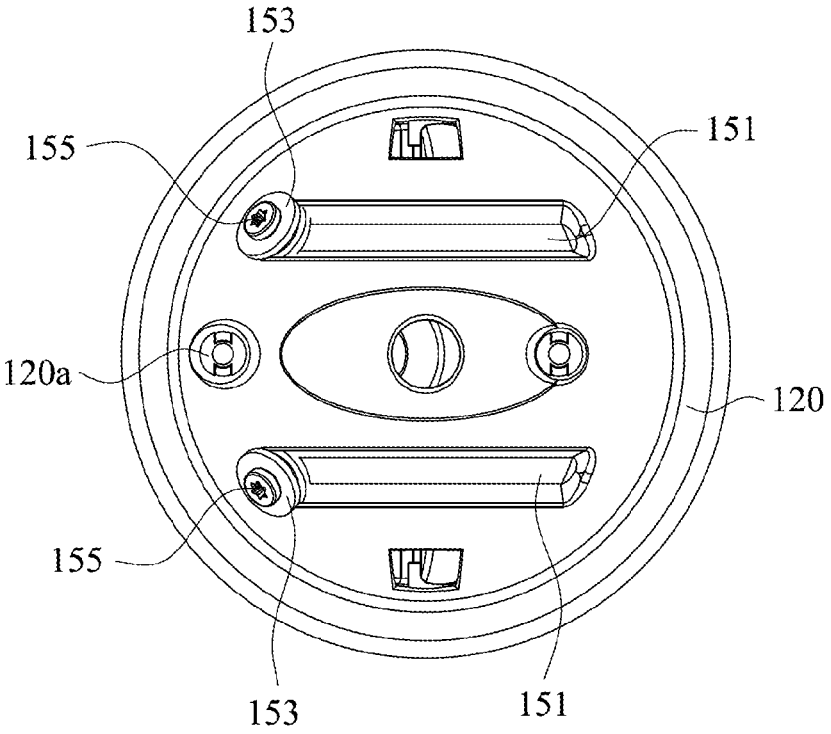
FIG. 9A and FIG. 9B are schematic diagrams showing the spherical shell being rotated counterclockwise 45 degrees along the second direction.
Figure 9B:
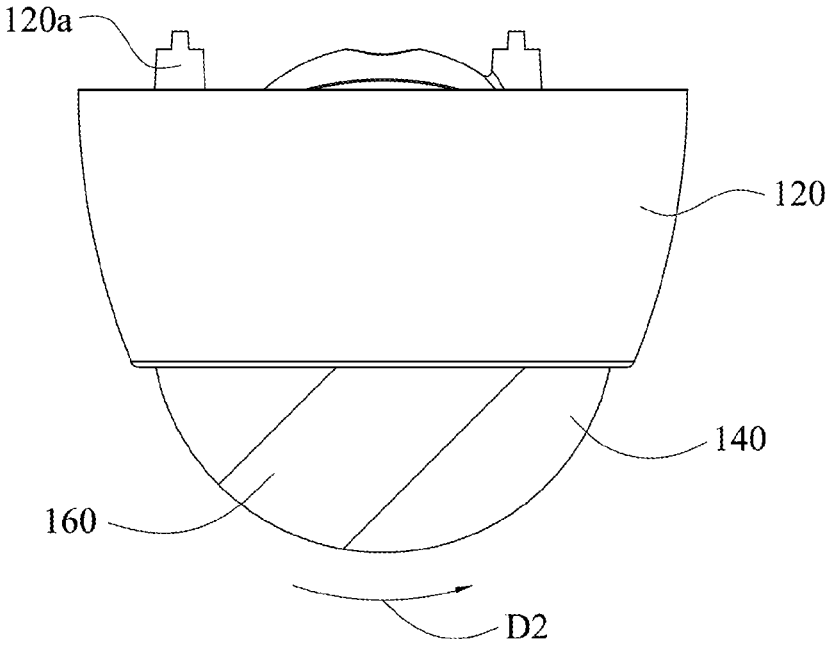

Referring to FIG. 9A and FIG. 9B, FIG. 9A and FIG. 9B are schematic diagrams showing the spherical shell 140 being rotated counterclockwise 45 degrees along the second direction D2. It is noted that, in order to clearly illustrate the rotation of the spherical shell 140, the lamp base 110 is not illustrated in FIG. 9A and FIG. 9B. When the sliding member 153 is rotated counterclockwise 45 degrees relative to the case body 120 along the second direction D2 from the starting position, the light emitting direction of the light source 160 rotates counterclockwise 45 degrees along with the spherical shell 140, and the sliding member 153 moves to the other end of the second sliding chute 151 accordingly. Therefore, the light emitting direction of the light source 160 can be changed by rotating the spherical shell 140. It is noted that, the rotation angle of the spherical shell 140 is related to the extending arc-length of the second sliding chute 151. Therefore, in other embodiments, the extending arc-length of the second sliding chute 151 can be designed according to rotation angles required by spherical shell 140, so as to meet practical requirements.

In the present embodiment, the rotary adjustment mechanism 130 and the inclination adjustment mechanism 150 are disposed inside the lamp 100. Moreover, the spherical shell 140 is partially disposed in the inner space 120*a* of the case body 120 and partially extends out of the opening 120*d*. In addition, the light source 160 is disposed on the spherical shell 140 and is located outside the opening 120*d*. When the spherical shell 140 or the case body 120 is rotated, the light emitting direction of the light source 160 changes accordingly but the exterior appearance of the lamp 100 is unchanged. Therefore, when multiple lamps 100 with different light emitting directions are applied in the same space, each lamp 100 has the same exterior appearance, to make the visual effect in the space more organized.

Figure 10:
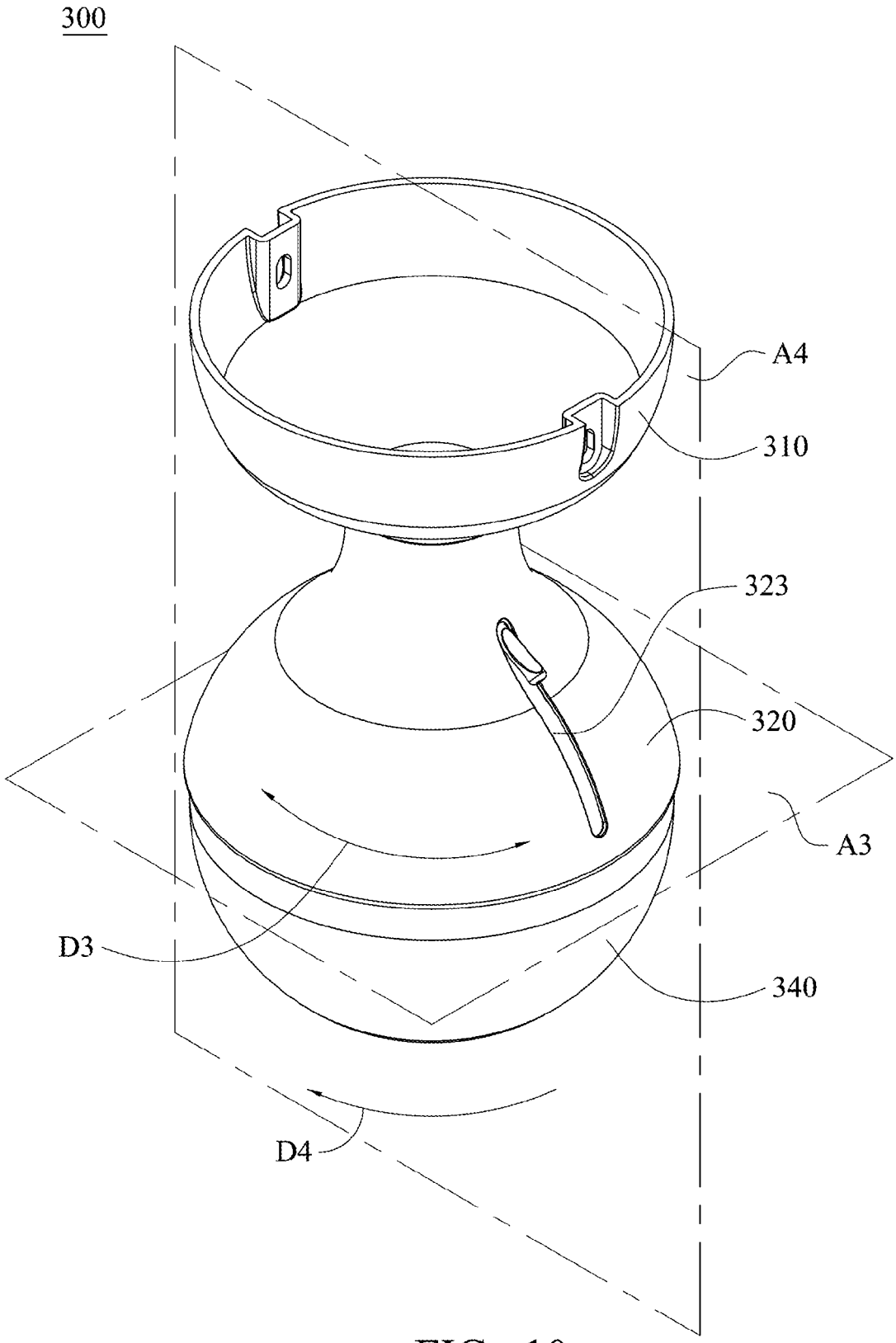
FIG. 10 is a schematic diagram showing a lamp in accordance with a second embodiment of the present invention.
Figure 11:
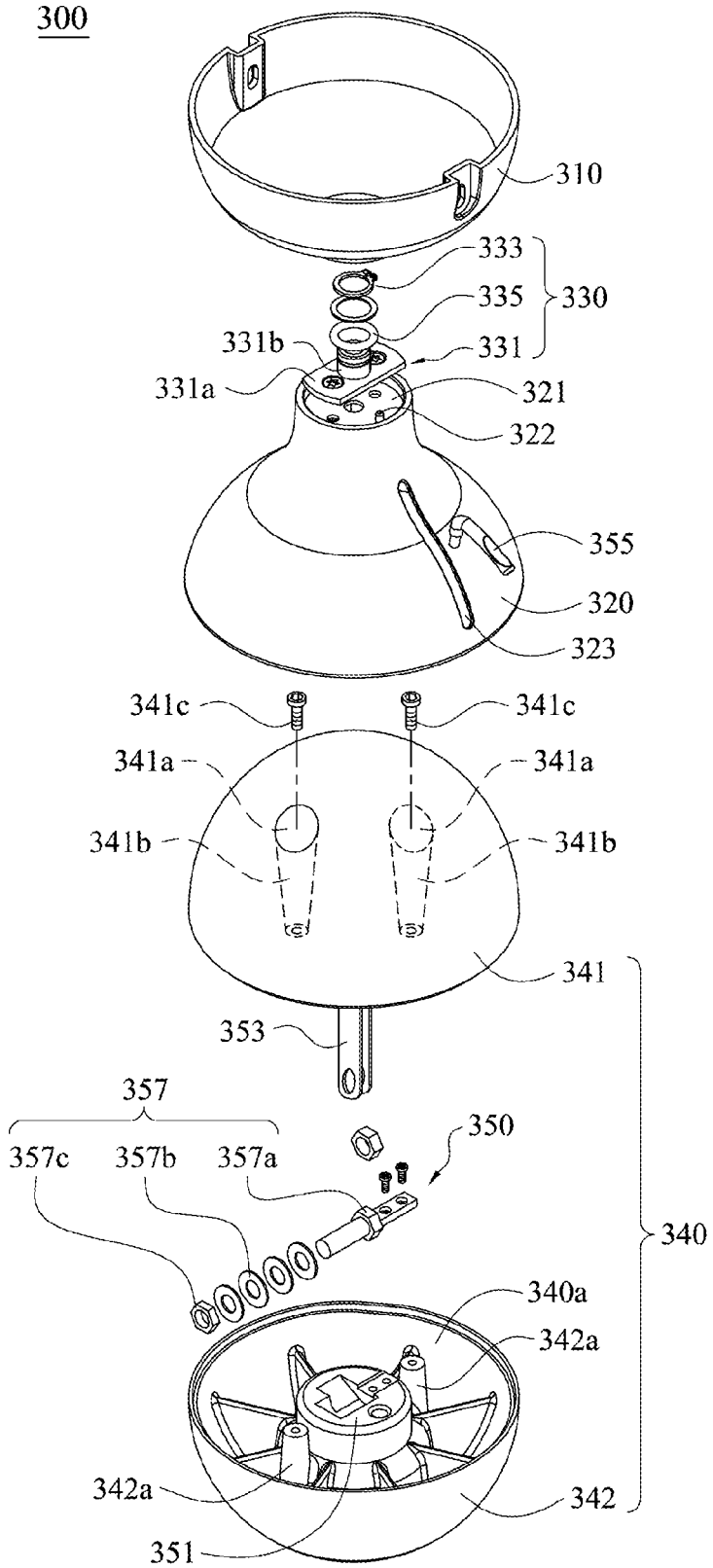
FIG. 11 is a schematic exploded view showing the lamp in accordance with the second embodiment of the present invention.
Figure 12:
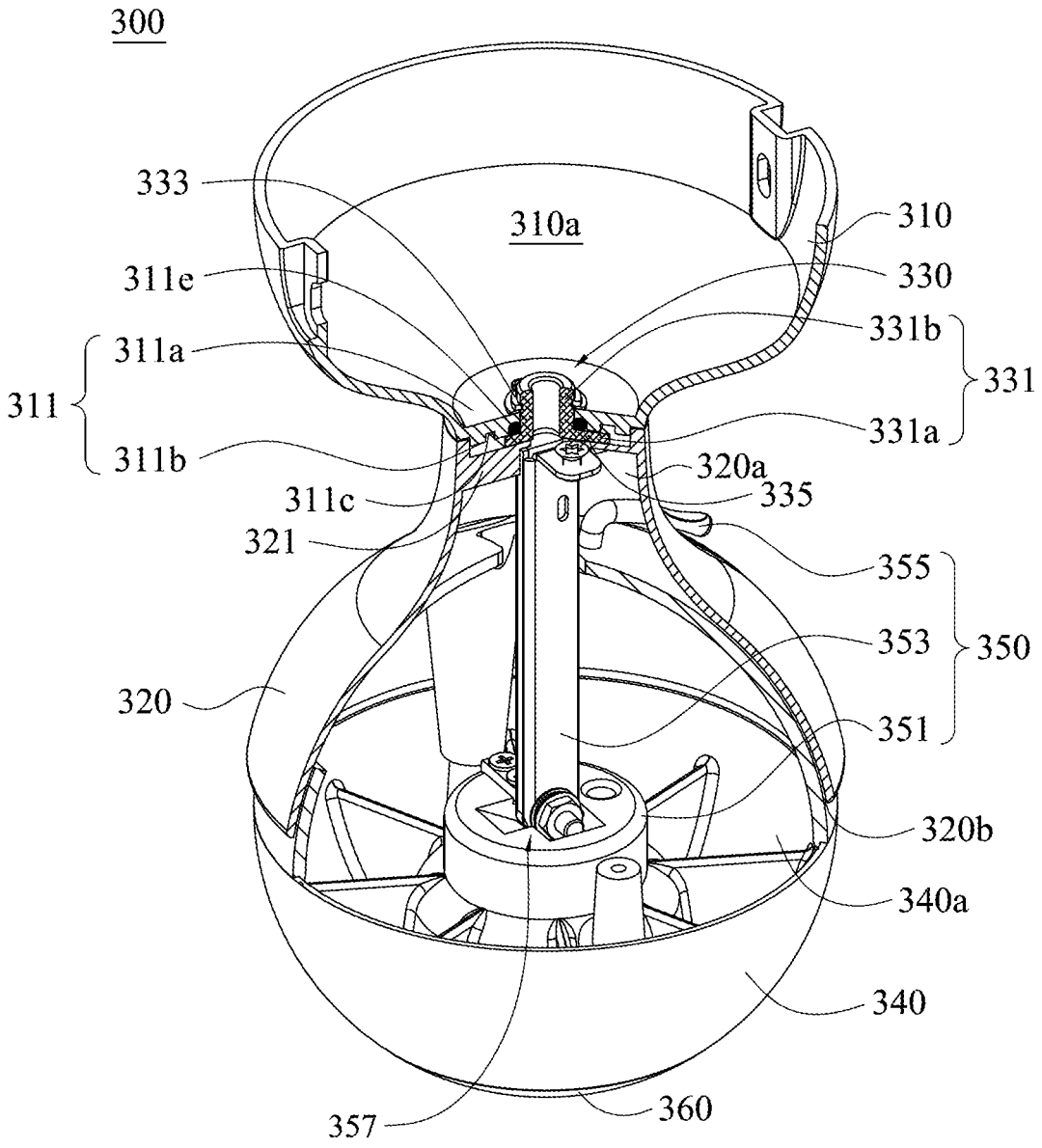
FIG. 12 is a partial cross-sectional view showing the lamp in accordance with the second embodiment of the present invention.

In the present invention, the lamp 100 may have different designs. Referring to FIG. 10 to FIG. 12, FIG. 10 to FIG. 12 are a schematic diagram, a schematic exploded view showing and a partial cross-sectional view showing a lamp 300 in accordance with a second embodiment of the present invention. The lamp 300 mainly includes a rotary adjustment mechanism 330, an inclination adjustment mechanism 350 and a light source 360. As shown in FIG. 10, the light source 360 is rotatable along a first direction D3 in a first plane A3 by the rotary adjustment mechanism 330 and/or rotatable relative along a second direction D4 in a second plane A4 by the inclination adjustment mechanism 350. In the present embodiment, the second plane A4 is different from the first plane A3. As shown in FIG. 10 to FIG. 12, the lamp 300 further includes a lamp base 310, a case body 320 and a spherical shell 340. The rotary adjustment mechanism 330 is mainly disposed in an inner space 310*a* of the lamp base 310 and/or an inner space 320*a* of the case body 320 and can be used to connect the lamp base 310 and the case body 320, so as to enable the case body 320 to rotate relative to the lamp base 310 along the first direction D3 in the first plane A3. The inclination adjustment mechanism 350 is disposed in the inner space 320*a* of the case body 320 and can be used to connect the case body 320 and the spherical shell 340, so as to enable the spherical shell 340 to rotate relative to the case body 320 along the second direction D4 in the second plane A4. Moreover, the light source 360 is disposed on the spherical shell 340, so that light emitting direction of the light source 360 can be changed by adjusting the rotary adjustment mechanism 330 and the inclination adjustment mechanism 350. As shown in FIG. 10, the first plane A3 and the second plane A4 are imaginary planes, and the first plane A1 is different from the second plane A4. In one embodiment, the first plane A3 is perpendicular to the second plane A4.

Referring to FIG. 10 to FIG. 12 again, in the present embodiment, the lamp base 310 includes a bottom portion 311, and the bottom portion 311 has a top surface 311*a* and a bottom surface 311*b* opposite to each other. The rotary adjustment mechanism 330 includes a connecting member 331, a retaining ring 333 and a positioning ring 335. The connecting member 331 is fixed on the case body 320. As shown in FIG. 11 and FIG. 12, the connecting member 331 includes a bottom base 331*a* and a convex portion 331*b*. The convex portion 331*b* protrudes from the bottom base 331*a*. Moreover, the convex portion 331*b* of the connecting member 331 penetrates through the bottom portion 311 of the lamp base 310 and extends to the inner space 310*a* of the lamp base 310. Meanwhile, the bottom base 331*a* of the connecting member 331 abuts against the bottom surface 311*b* of the bottom portion 311 of the lamp base 310. The retaining ring 333 is mounted on the convex portion 331*b* of the connecting member 331 in the inner space 310*a* of the lamp base 310 and abuts against the top surface 311*a* of the bottom portion 311 of the lamp base 310, so as to clamp and fix the connecting member 331. In one example, the retaining ring 333 is a C-shaped circlip or C-ring.

Figure 13A:
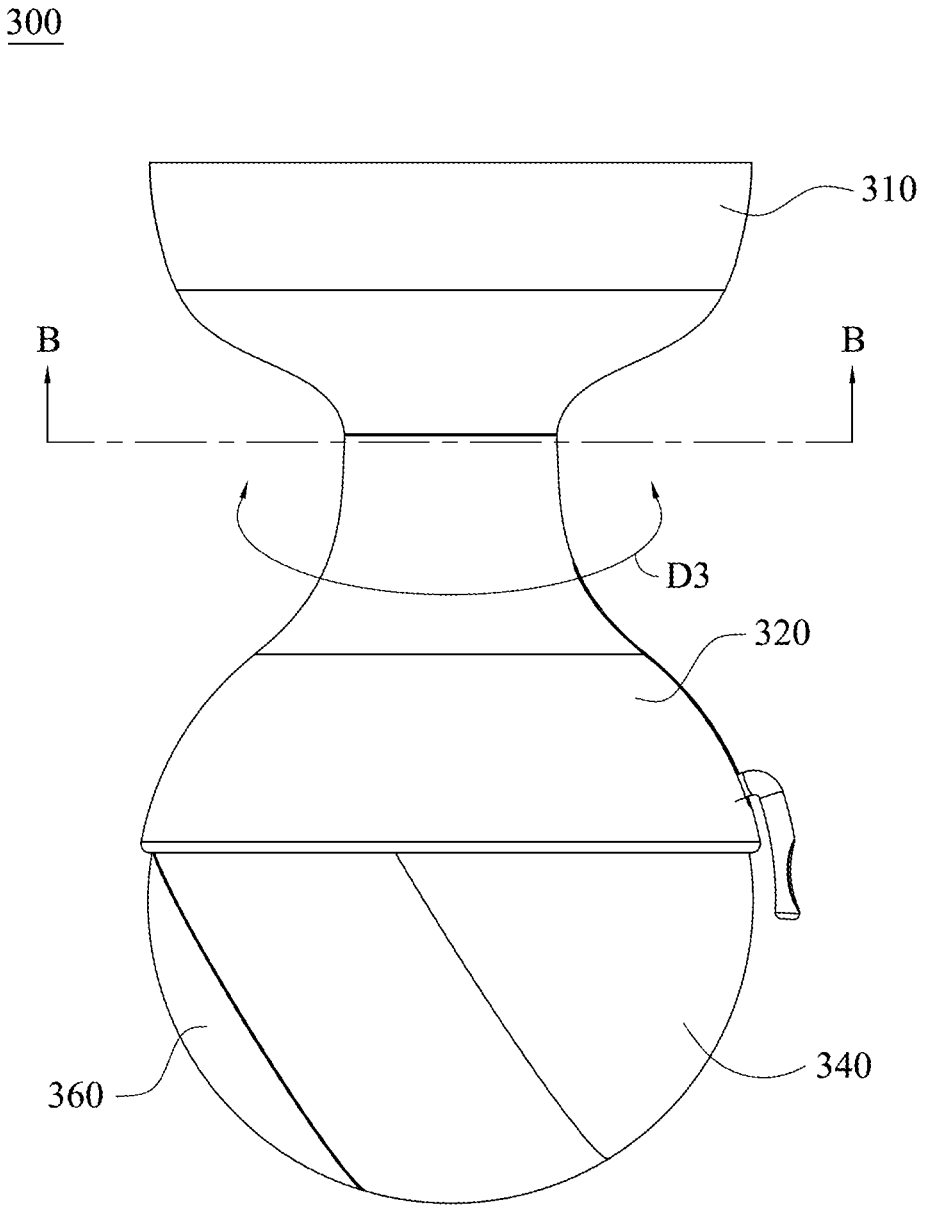
FIG. 13A is a schematic side view showing a case body at a starting position in accordance with the second embodiment of the present invention.
Figure 13B:
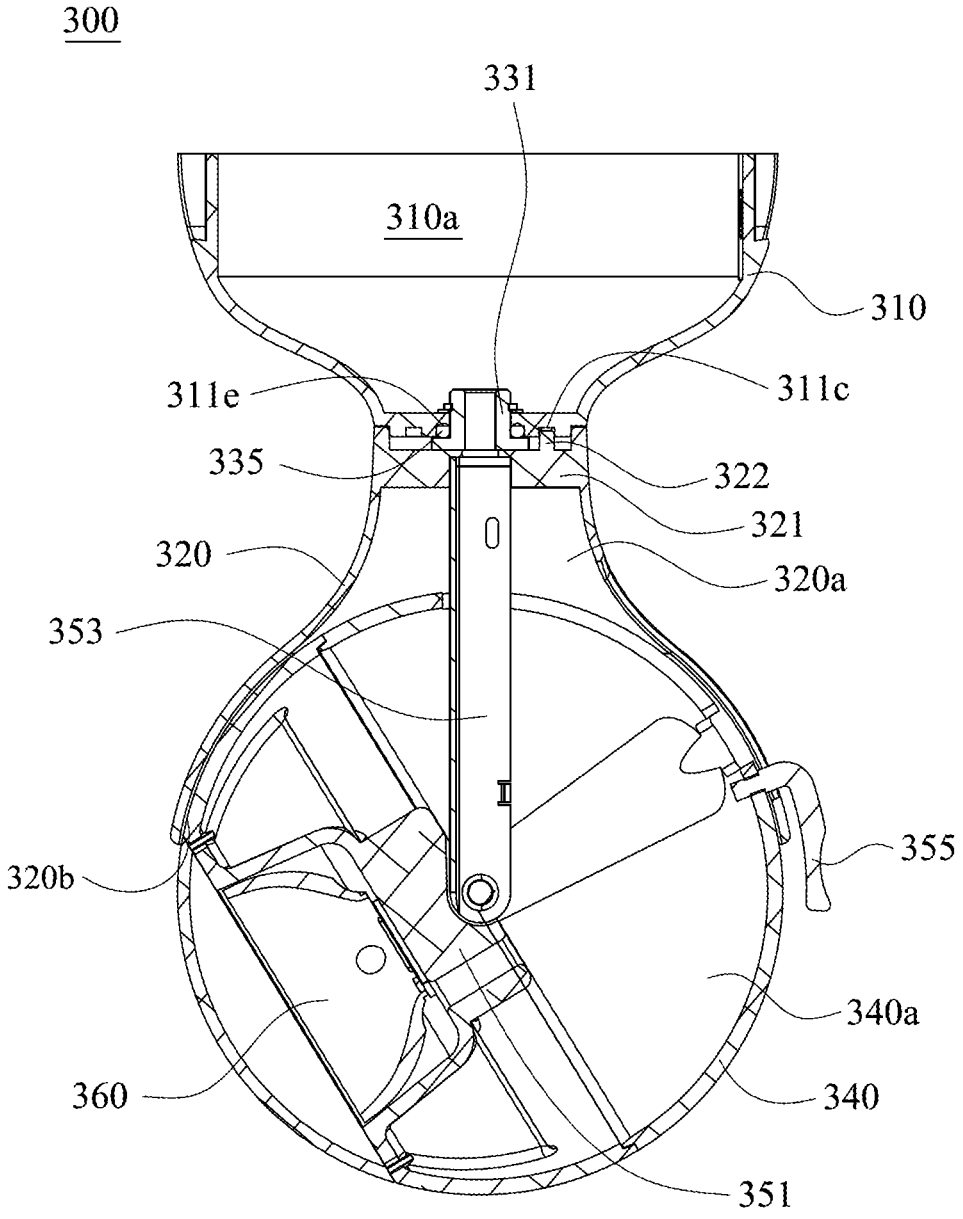
FIG. 13B is a cross-sectional view showing the case body in the starting position in accordance with the second embodiment of the present invention.
Figure 13C:
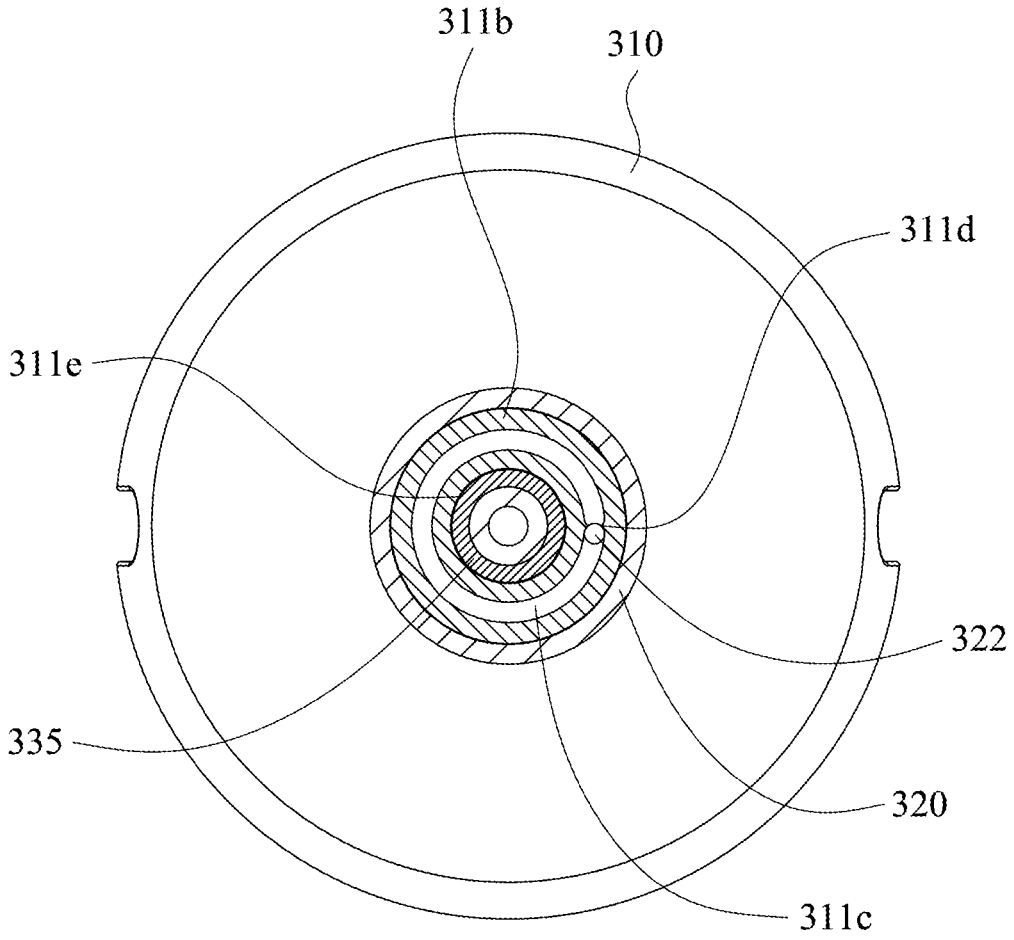
FIG. 13C is a schematic cross-sectional view taken along a line B-B in FIG. 13A.

Simultaneously referring to FIG. 11 to FIG. 13C, in which FIG. 13A and FIG. 13B are a schematic side view and a cross-sectional view showing the case body 320 at a starting position in accordance with the second embodiment of the present invention, and FIG. 13C is a schematic cross-sectional view taken along a line B-B in FIG. 13A. A sliding chute 311*c*, a stopper 311*d* and a recess 311*e* are disposed on the bottom surface 311*b* of the bottom portion 311 of the lamp base 310. In addition, the case body 320 includes a top portion 321, a convex post 322 and an opening 320*b*. The convex post 322 extends from the top portion 321. Therefore, when the case body 320 is rotated relative to the lamp base 310 along the first direction D3, the convex post 322 of the case body 320 can slide in the sliding chute 311*c*. In some embodiments, as shown in FIG. 13C, the sliding chute 311*c* is an annular chute, and a portion of width of the annular chute is getting narrower to form the stopper 311*d*. In the present embodiment, the width of the annular chute is approximately larger than that of the convex post 322, so that the convex post 322 can move in the annular chute. In addition, the width of the stopper 311*d* is approximately smaller than that of the convex post 322. Therefore, when the convex post 322 is moved to a position near the stopper 311*d*, the stopper 311*d* will block the convex post 322. As a result, the stopper 311*d* can limit the rotation angle of the case body 320, so as to prevent the wires in the lamp 300 from being entangled together due to the over-rotation of the case body 320.

Referring to FIG. 11 to FIG. 13C, in the present embodiment, the positioning ring 335 is disposed in the recess 311*e* and abuts against the bottom base 331*a* of the connecting member 331. The positioning ring 335 is used to increase the friction between the connecting member 331 and the lamp base 310, so as to ensure that the case body 320 can be positioned at a precise position. In one example, the positioning ring 335 can be an O-ring.

Figure 14A:
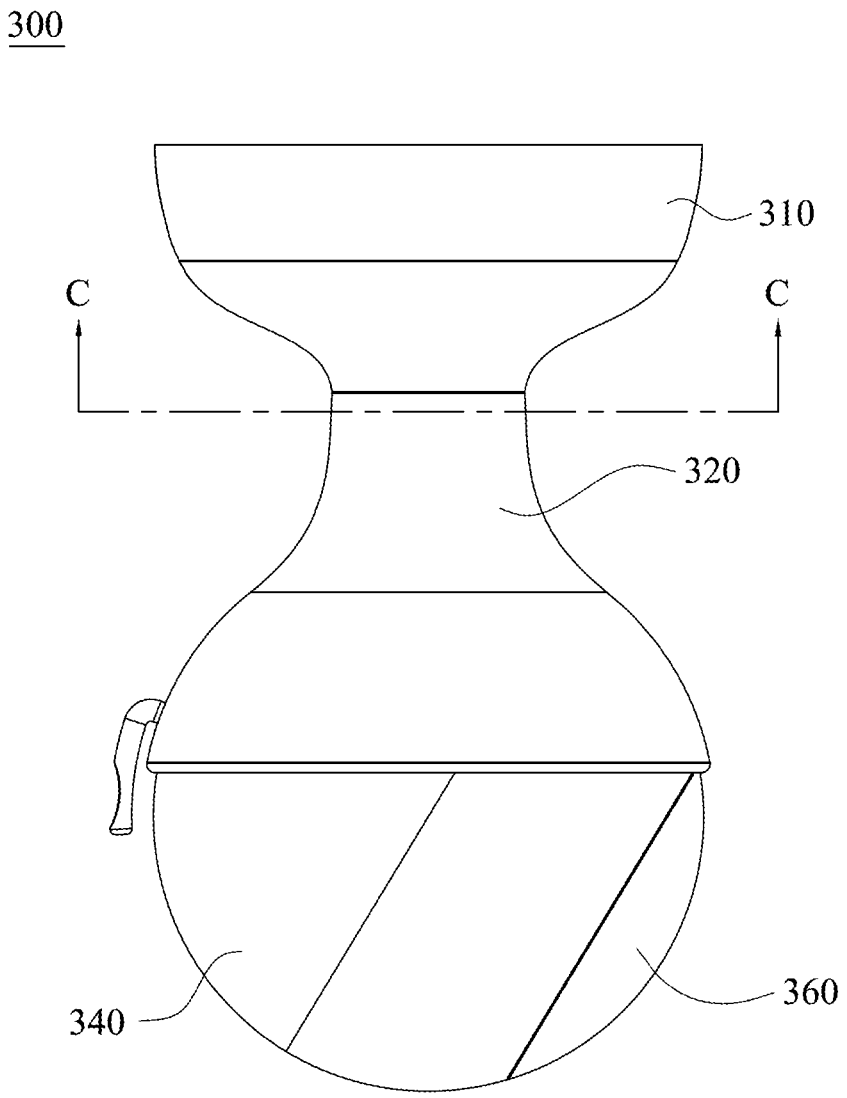
FIG. 14A is a schematic diagram showing the case body being rotated 185 degrees along a first direction in accordance with the second embodiment of the present invention.
Figure 14B:
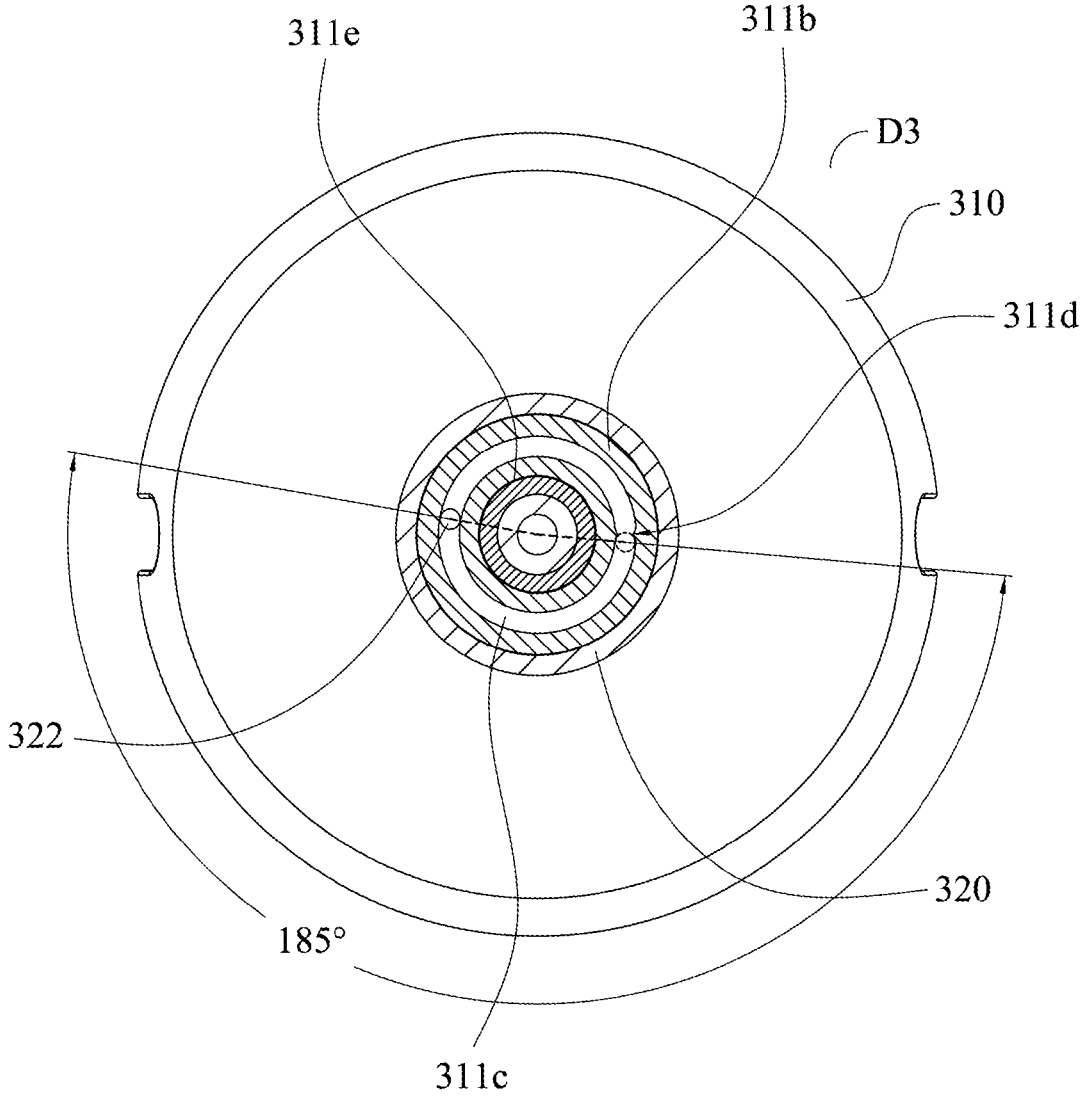
FIG. 14B is a schematic cross-sectional view taken along a line C-C in FIG. 14A.
Figure 14C:
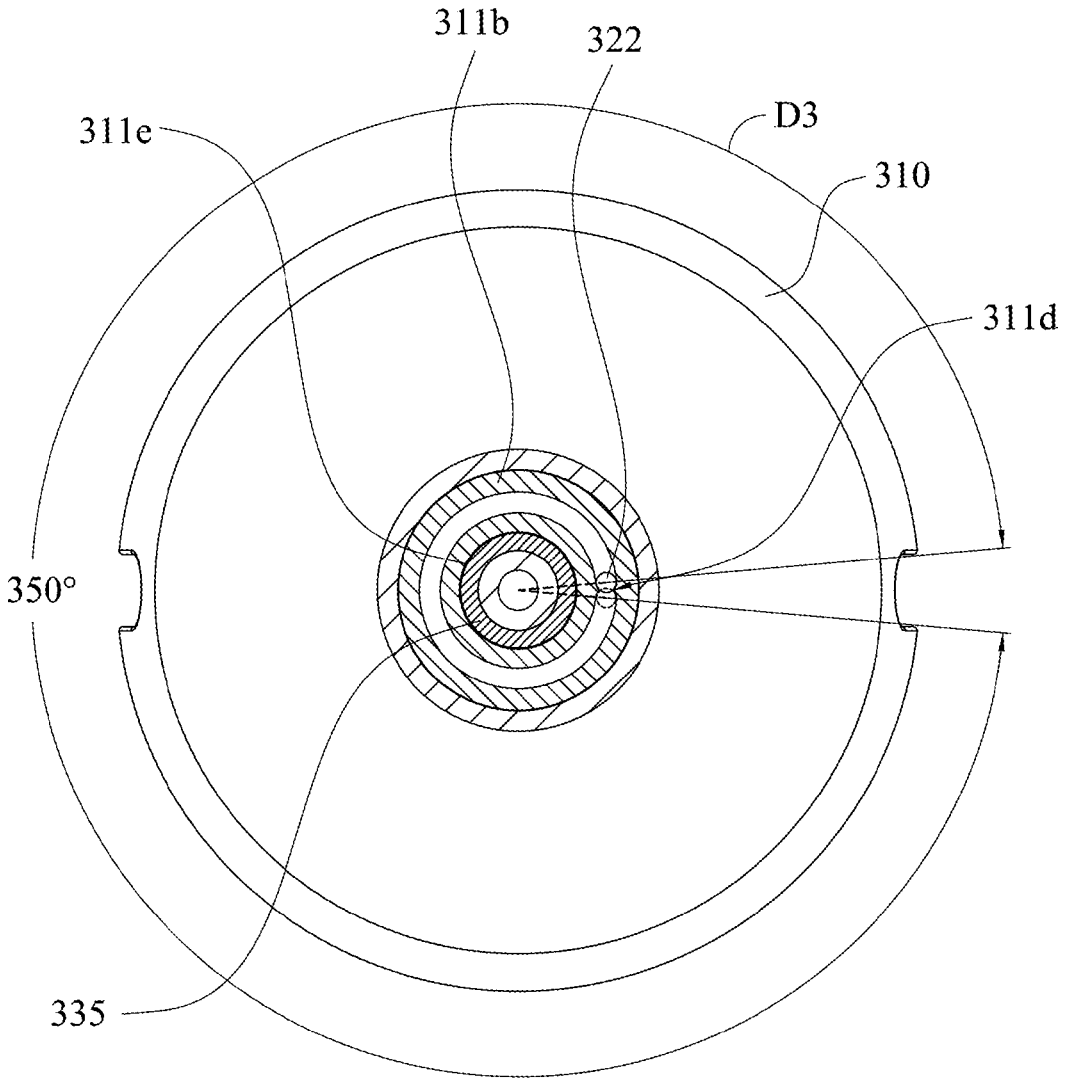
FIG. 14C is a schematic diagram showing the case body being rotated 350 degrees along the first direction in accordance with the second embodiment of the present invention.

As shown in FIG. 13A and FIG. 13B, the case body 320 is at the starting position, and the convex post 322 is at one end of the sliding chute 311*c*. Simultaneously referring to FIG. 10 and FIG. 14A to FIG. 14C, in which FIG. 14A is a schematic diagram showing the case body 320 being rotated 185 degrees along the first direction D3 in accordance with the second embodiment of the present invention, FIG. 14B is a schematic cross-sectional view taken along a line C-C in FIG. 14A, and FIG. 14C is a schematic diagram showing the case body 320 being rotated 350 degrees along the first direction D3 in accordance with the second embodiment of the present invention. When the case body is rotated 185 degrees relative to the lamp base 310 along the first direction D3 from the starting position, the light emitting direction of the light source 360 rotates 185 degrees along with the case body 320 (as shown in FIG. 14A), and the convex post 322 moves to a middle position of the sliding chute 311*c* (as shown in FIG. 14B) accordingly. In some embodiments, the maximum rotation angle of the case body 320 is 350 degrees. In other words, when the case body 320 is rotated from one end of the sliding chute 311*c* until the convex post 322 moves to the other end (as shown in FIG. 14C), the light emitting direction of the light source 360 rotates 350 degrees along with the case body 320 accordingly. It is noted that, the rotation angle of the case body 320 is related to the extending arc-length of the sliding chute 311*c* or the location of the stopper 311*d*. Therefore, in other embodiments, the extending arc-length of the first sliding chute 311*c* or the location of the stopper 311*d* can be designed according to required rotation angles of the case body 320, so as to meet practical requirements.

Referring to FIG. 10 to FIG. 12 again, the spherical shell 340 includes an upper spherical shell 341 and a lower spherical shell 342, in which an inner space 340*a* of the spherical shell 340 is formed between the upper spherical shell 341 and the lower spherical shell 342. As shown in FIG. 11, the upper spherical shell 341 has at least one post opening 341*a* and at least one connecting post 341*b*. The lower spherical shell 342 has at least one supporting post 342*a* corresponding to the connecting post 341*b*. Therefore, the upper spherical shell 341 and the lower spherical shell 342 are combined together by penetrating a fixing member 341*c* (e.g. a screw) through the connecting post 341*b* from the post opening 341*a* of the upper spherical shell 341 to fix the supporting post 342*a*. The inclination adjustment mechanism 350 includes a swing base 351, a connecting stem 353, an adjusting member 355 and a pivot mechanism 357. The swing base 351 is disposed in the inner space 340*a* of the spherical shell 340 and is connected to the spherical shell 340. One end of the connecting stem 353 is pivoted on the swing base 351 by the pivot mechanism 357, and the other end of the connecting stem 353 penetrates the spherical shell 340 and is fixed on a top portion 321 of the case body 320. As shown in FIG. 11 and FIG. 12, the pivot mechanism 357 includes a pivot shaft 357*a*, a resilient pad 357*b* and a fixing member 357*c*. One end of the pivot shaft 357*a* is fixed on the swing base 351, and the other end of the pivot shaft 357*a* penetrates the connecting stem 353. Therefore, the spherical shell 340 can swing around the pivot between the connecting stem 353 and the swing base 351. Moreover, the fixing member 357*c* and the resilient pad 357*b* are disposed on the pivot shaft 357*a*, and the fixing member 357*c* abuts the resilient pad 357*b* on the connecting stem 353. Therefore, the swing base 351 can be positioned at a required position by the friction between the resilient pad 357*b* and the connecting stem 353, so as to prevent the spherical shell 340 from randomly swaying. In addition, a groove 323 is disposed on the case body 320, and the adjusting member 355 is disposed through the groove 323 from outside of the case body 320 and is connected to the spherical shell 340. The spherical shell 340 can swing relative to the connecting stem 353 by manipulating the adjusting member 355. In one example, the adjusting member 355 is a driving lever. Therefore, when the adjusting member 355 is moved in the groove 323, the spherical shell 340 swings along the second direction D4 accordingly.

Figure 15A:
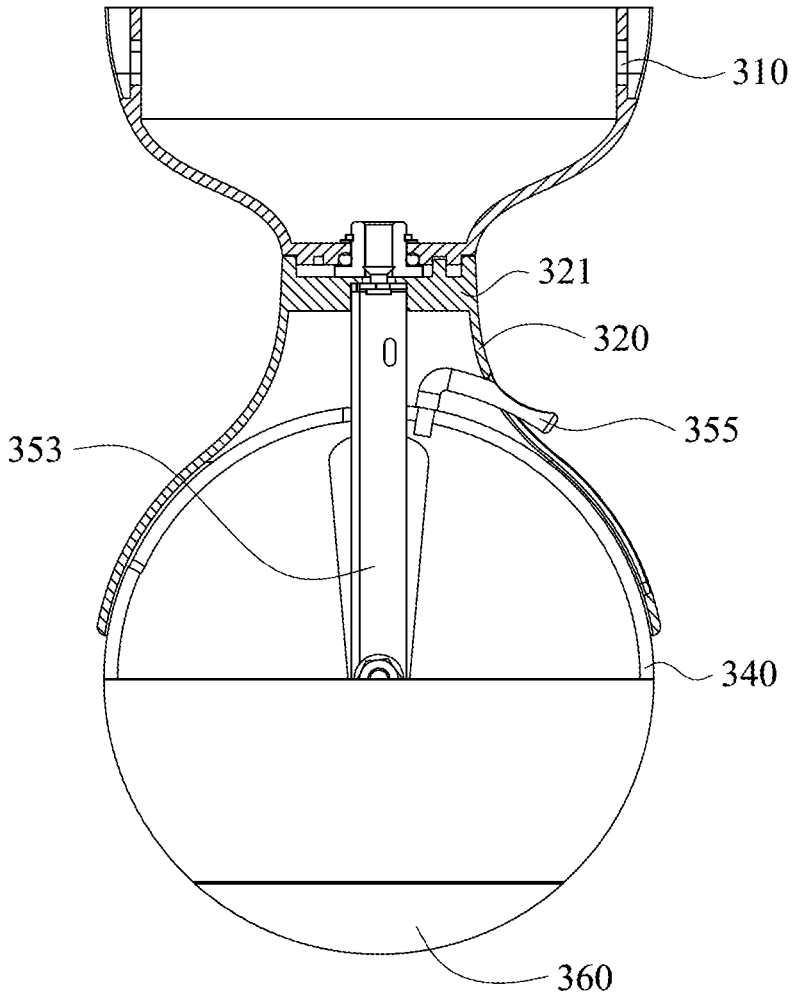
FIG. 15A is a cross-sectional view showing a spherical shell at a starting position in accordance with the second embodiment of the present invention.
Figure 15B:
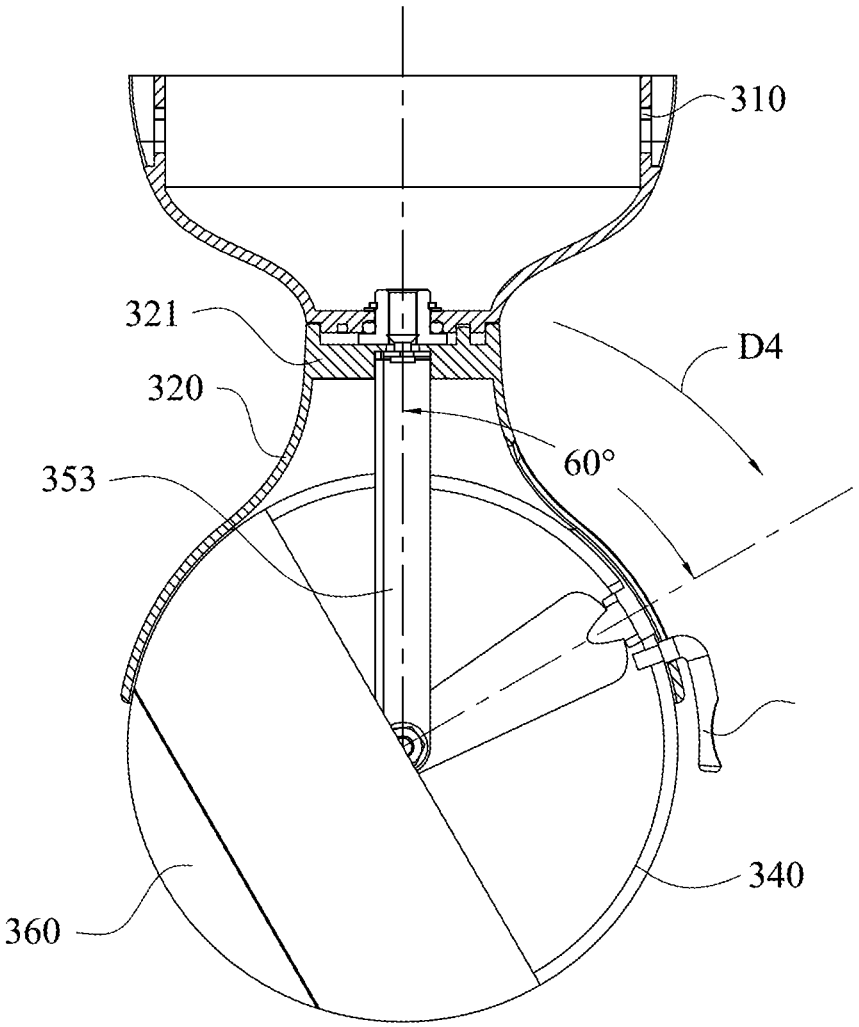
FIG. 15B is a schematic diagram showing the spherical shell being rotated 60 degrees along a second direction.

Simultaneously referring to FIG. 10, FIG. 12, FIG. 15A and FIG. 15B, in which FIG. 15A is a cross-sectional view showing the spherical shell 340 at a starting position in accordance with the second embodiment of the present invention, and FIG. 15B is a schematic diagram showing the spherical shell 340 being rotated 60 degrees along the second direction D4. As shown in FIG. 10, FIG. 12 and FIG. 15A, the spherical shell 340 is at the starting position, and the adjusting member 355 is disposed at a top end of the groove 323. When the adjusting member 355 is moved in the groove 323, the spherical shell 340 rotates along the second direction D4 accordingly. At the same time, the light emitting direction of the light source 360 can be changed together with the rotation of the spherical shell 340. As shown in FIG. 15B, when the adjusting member 355 is moved to a bottom end of the groove 323, the light emitting direction of the light source 360 rotated 60 degrees along with the rotation of the spherical shell 340 accordingly. It is noted that, the rotation angle of the spherical shell 340 is related to the extending arc-length of the groove 323. Therefore, in other embodiments, the extending arc-length of the groove 323 can be designed according to required rotation angles of the spherical shell 340, so as to meet practical requirements.

In the present embodiment, the rotary adjustment mechanism 330 and the inclination adjustment mechanism 350 are disposed inside the lamp 300. Moreover, the spherical shell 340 is partially disposed in the inner space 320*a* of the case body 320 and partially extends out of the opening 320*b*. In addition, the light source 360 is disposed on the spherical shell 340 and is located outside the opening 320*b*. When the spherical shell 340 or the case body 320 is rotated, the light emitting direction of the light source 360 changes accordingly but the exterior appearance of the lamp 300 is unchanged. Therefore, when multiple lamps 300 with different light emitting directions are applied in the same space, each lamp 300 has the same exterior appearance, to make the visual effect in the space more organized.

Figure 16:
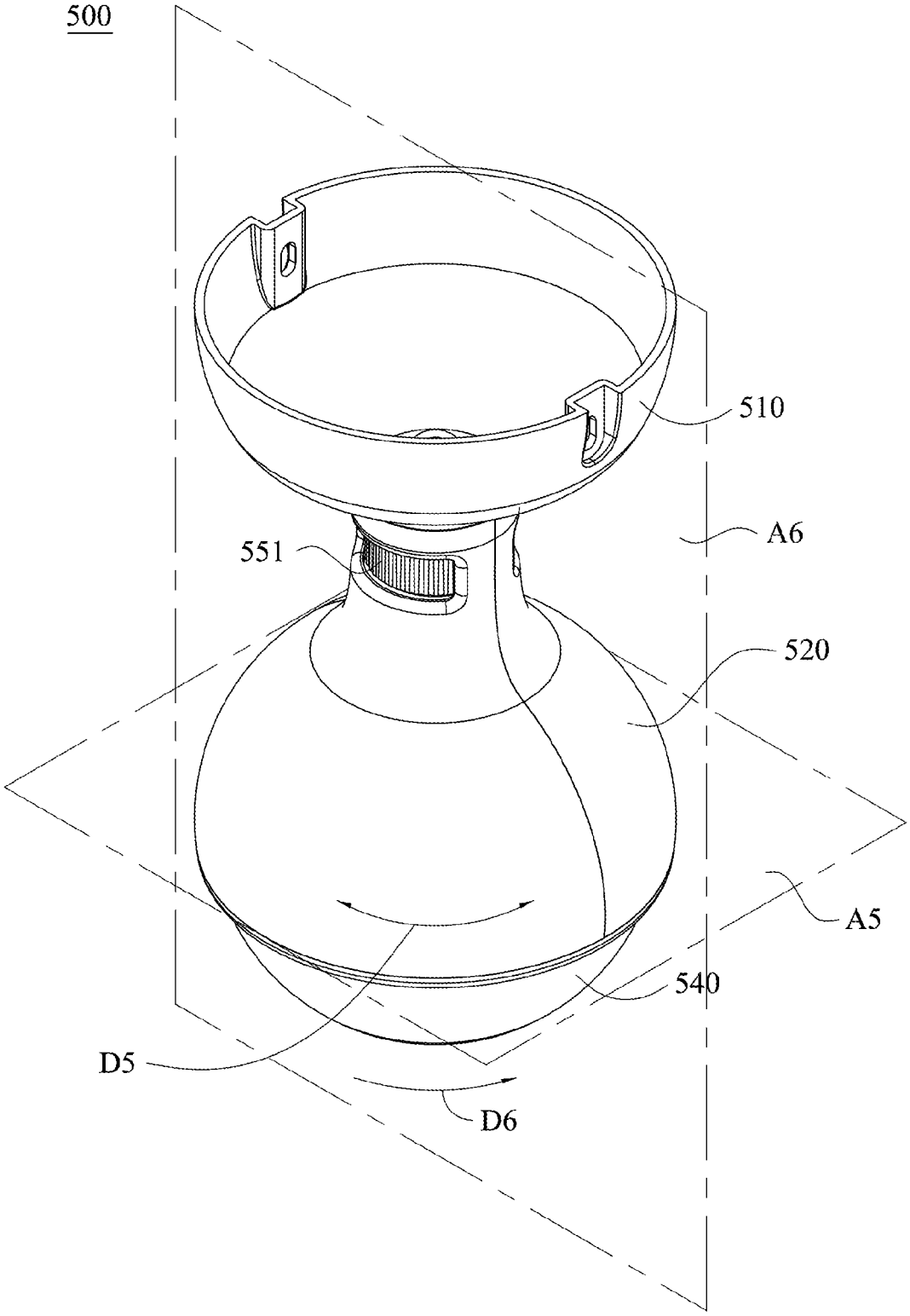
FIG. 16 is a schematic diagram showing a lamp in accordance with a third embodiment of the present invention.
Figure 17:
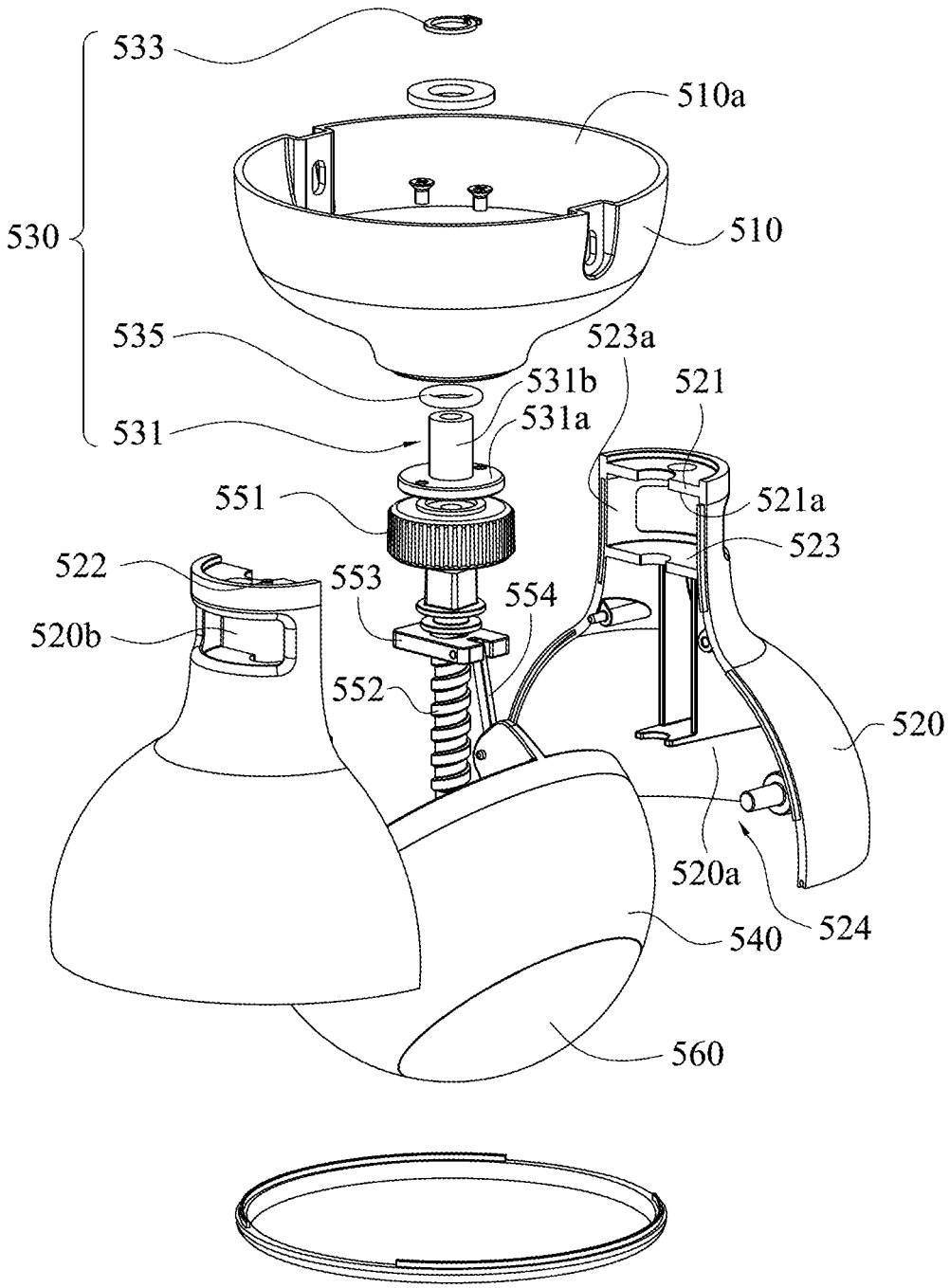
FIG. 17 is a schematic exploded view showing the lamp in accordance with the third embodiment of the present invention.
Figure 18:
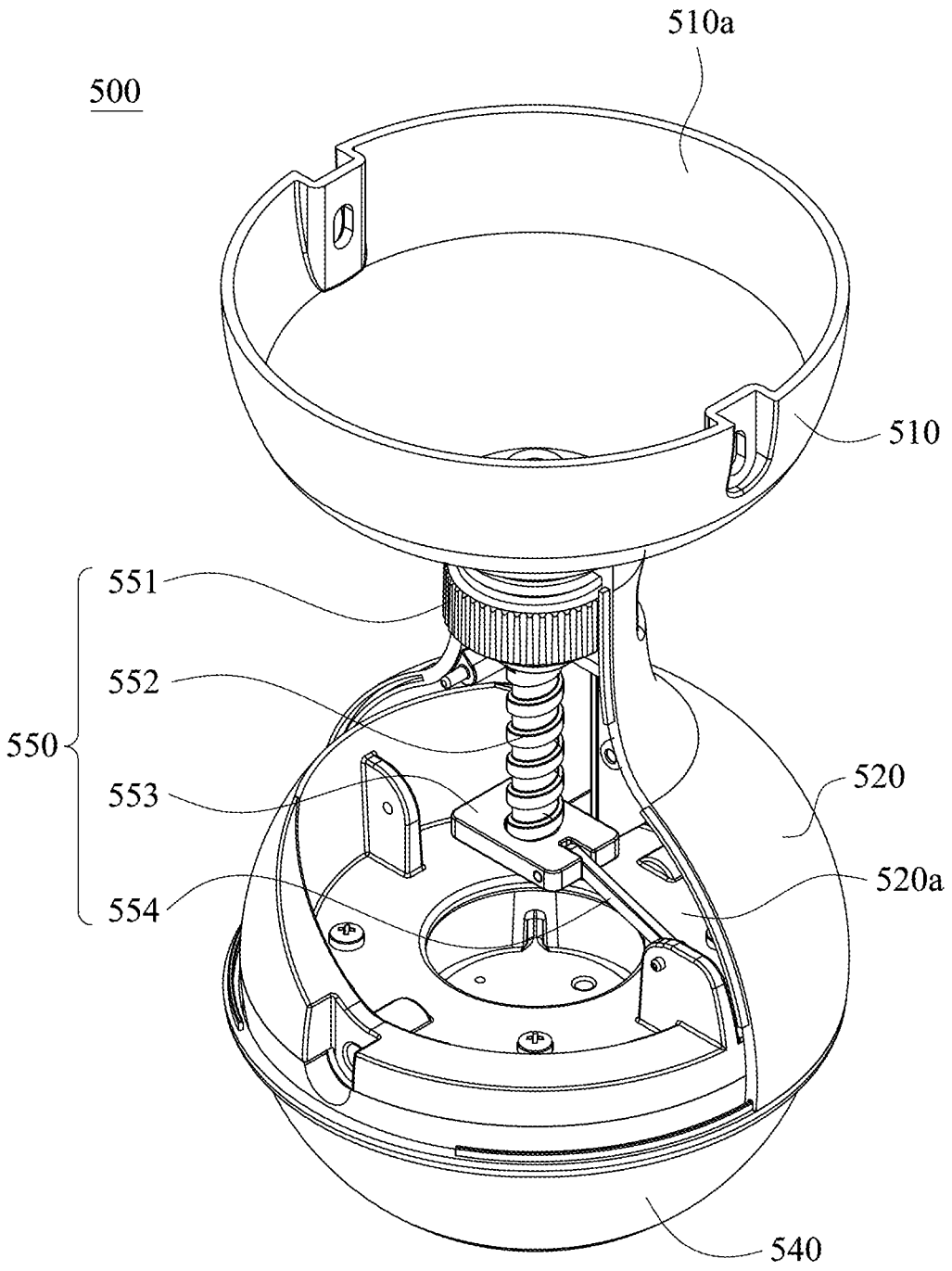
FIG. 18 is a partial cross-sectional view showing the lamp in accordance with the third embodiment of the present invention.

In the present invention, the lamp 300 may have different designs. Referring to FIG. 16 to FIG. 18, FIG. 16 to FIG. 18 are a schematic diagram, a schematic exploded view and a partial cross-sectional view showing a lamp 500 in accordance with a third embodiment of the present invention. The lamp 500 mainly includes a rotary adjustment mechanism 530, an inclination adjustment mechanism 550 and a light source 560. As shown in FIG. 1, the light source 560 is rotatable along a first direction D5 in a first plane A5 by the rotary adjustment mechanism 530 and/or rotatable relative along a second direction D6 in a second plane A6 by the inclination adjustment mechanism 550. In the present embodiment, the second plane A6 is different from the first plane A5. As shown in FIG. 16 to FIG. 18, the lamp 500 further includes a lamp base 510, a case body 520 and a spherical shell 540. The rotary adjustment mechanism 530 is disposed in an inner space 510*a* of the lamp base 510 and/or an inner space 520*a* of the case body 520 and can be used to connect the lamp base 510 and the case body 520, so as to enable the case body 520 to rotate relative to the lamp base 510 along a first direction D5 in a first plane A5. The inclination adjustment mechanism 550 is disposed in the inner space 520*a* of the case body 520 and can be used to connect the case body 520 and the spherical shell 540, so as to enable the spherical shell 540 to rotate relative to the case body 520 along a second direction D6 in a second plane A6. Moreover, the light source 560 is disposed on the spherical shell 540, so that light emitting direction of the light source 560 can be changed by adjusting the rotary adjustment mechanism 530 and the inclination adjustment mechanism 550. As shown in FIG. 16, the first plane A5 and the second plane A6 are imaginary planes, and the first plane A5 is different from the second plane A6. In one embodiment, the first plane A5 is perpendicular to the second plane A6.

Figure 19A:
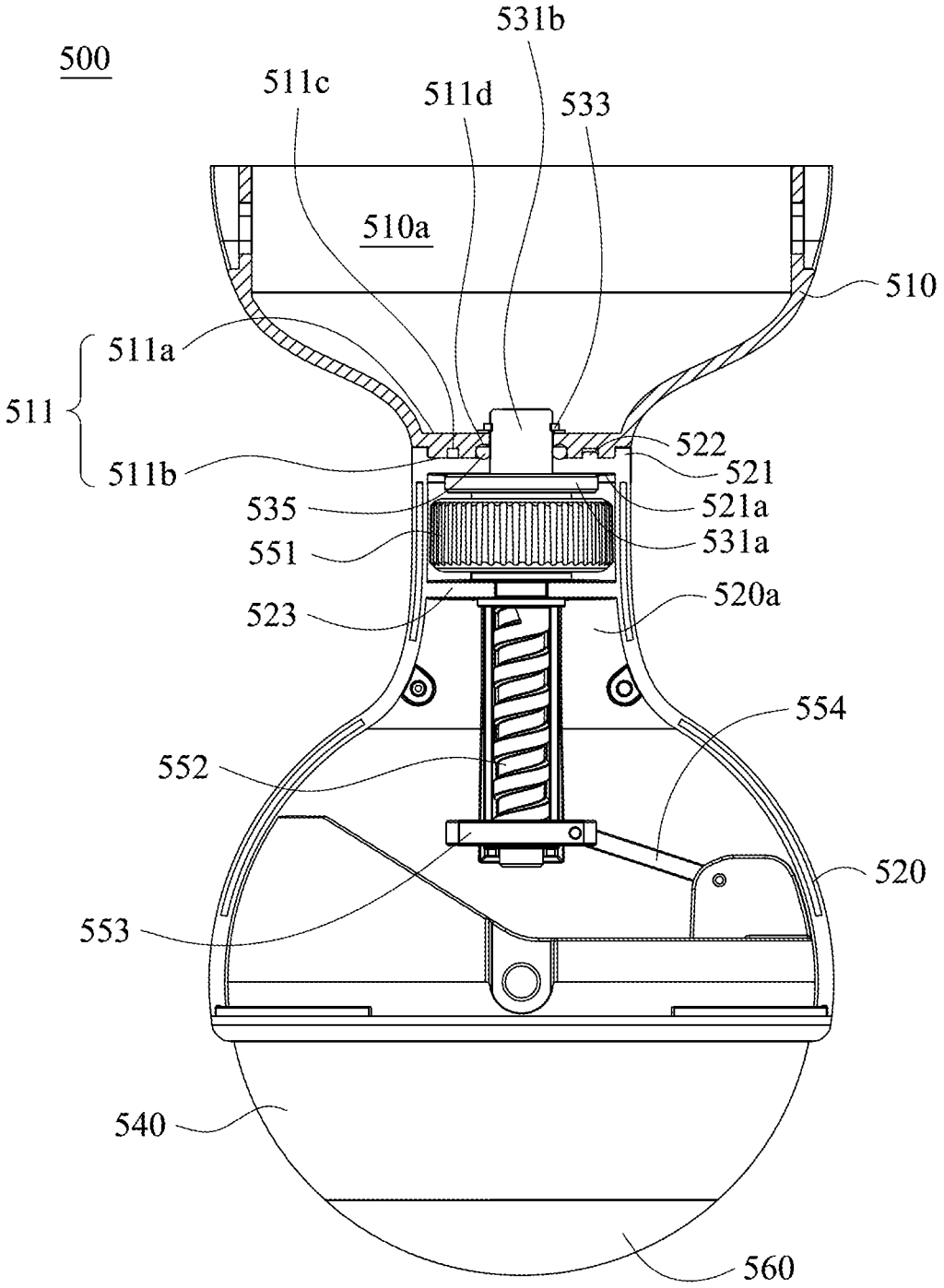
FIG. 19A is a cross-sectional view showing a spherical shell at a starting position in accordance with the third embodiment of the present invention.
Figure 19B:
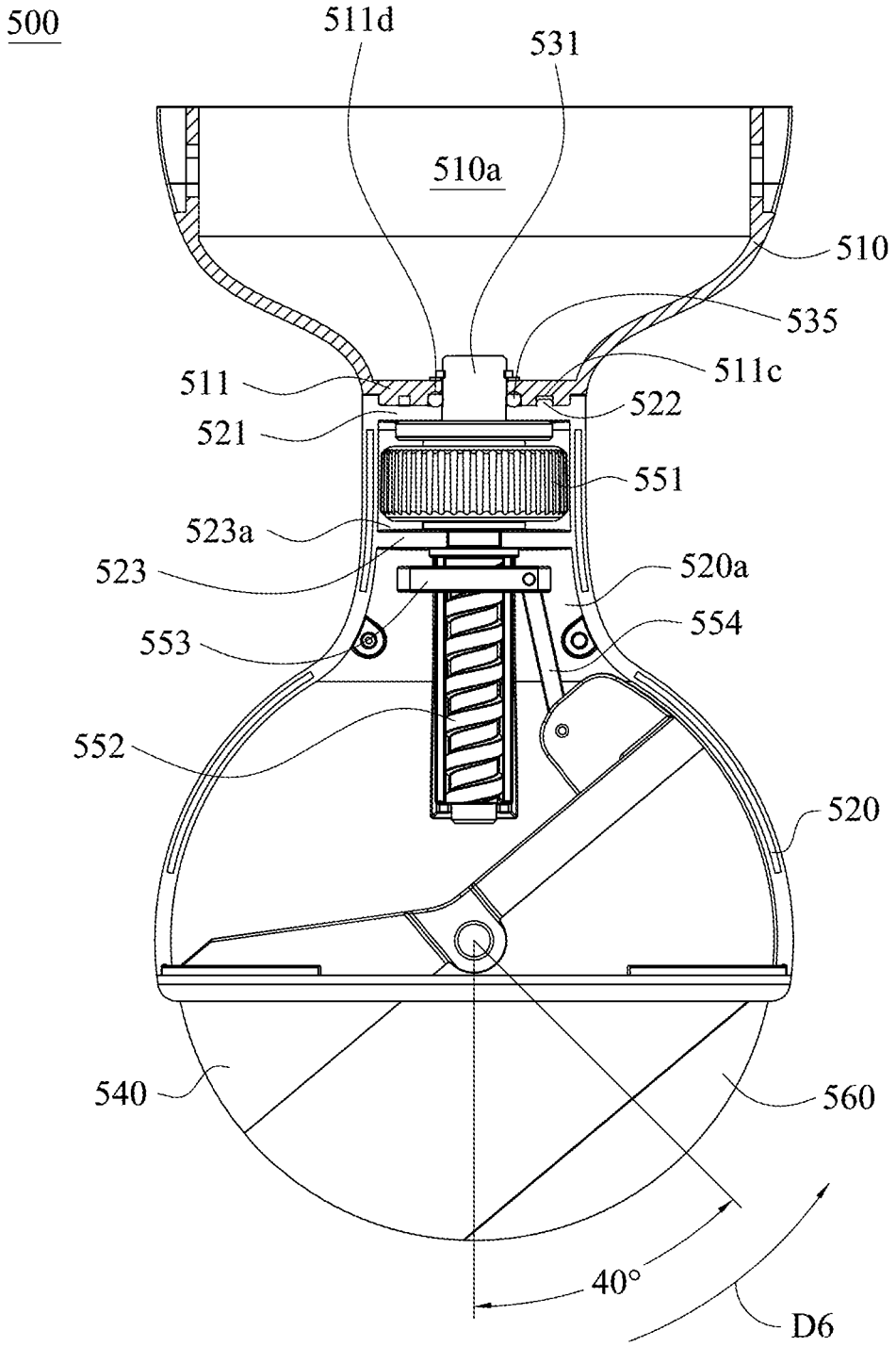
FIG. 19B is a schematic diagram showing the spherical shell being rotated 40 degrees along a second direction.

Referring to FIG. 16 to FIG. 19A, in which FIG. 19A is a cross-sectional view showing the spherical shell 540 at a starting position in accordance with the third embodiment of the present invention. In the present embodiment, the lamp base 510 includes a bottom portion 511, and the bottom portion 511 has a top surface 511*a* and a bottom surface 511*b* opposite to each other. In addition, the case body 520 includes a top plate 521, a convex post 522, a partition plate 523 and an opening 524. The convex post 522 extends from the top plate 521. An accommodating space 523*a* is formed between the top plate 521 and the partition plate 523.

As shown in FIG. 17 and FIG. 19A, the rotary adjustment mechanism 530 includes a connecting member 531, a retaining ring 533 and a positioning ring 535. The connecting member 531 is fixed on the case body 520. The connecting member 531 includes a bottom base 531*a* and a convex portion 531*b*. The convex portion 531*b* protrudes from the bottom base 531*a*. Moreover, the convex portion 531*b* of the connecting member 531 penetrates through the top plate 521 of the case body 520 and the bottom portion 511 of the lamp base 510, and extends to the inner space 510*a* of the lamp base 510. Meanwhile, the bottom base 531*a* of the connecting member 531 abuts against the bottom surface 521*a* of the top plate 521. The retaining ring 533 is mounted on the convex portion 531*b* of the connecting member 531 in the inner space 510*a* of the lamp base 510 and abuts against the top surface 511*a* of the bottom portion 511 of the lamp base 510, so as to clamp and fix the connecting member 531. In one example, the retaining ring 533 is a C-shaped circlip or C-ring.

Referring to FIG. 16 to FIG. 19A, the structure of the lamp base 510 is similar to that of the lamp base 310 shown in FIG. 10. A sliding chute 511*c*, a stopper (such as 311*d* in FIG. 13C) and a recess 511*d* are disposed on the bottom surface 511*b* of the bottom portion 511 of the lamp base 510. Therefore, when the case body 520 is rotated relative to the lamp base 510 along the first direction D5, the convex post 522 of the case body 520 can slide in the sliding chute 511*c*. In some embodiments, the positioning ring 535 is disposed in the recess 511*d* and is mounted on the convex portion 531*b* of the connecting member 531. The positioning ring 535 is used to increase the friction between the connecting member 531 and the lamp base 510, so as to ensure that the case body 520 can be positioned at a precise position. In one example, the positioning ring 535 can be an O-ring. It is noted that, the rotation angle of the case body 520 is related to the extending arc-length of the sliding chute 511*c* or the location of the stopper. Therefore, in other embodiments, the extending arc-length of the first sliding chute 511*c* or the location of the stopper can be designed according to required rotation angles of the case body 520, so as to meet practical requirements.

Simultaneously referring to FIG. 17 to FIG. 19B, FIG. 19B is a schematic diagram showing the spherical shell 540 being rotated 40 degrees along the second direction D6. The inclination adjustment mechanism 550 mainly includes an adjusting member 551, a threaded rod 552, a sliding block 553 and a connecting rod 554. The adjusting member 551 is rotatably disposed in the accommodating space 523*a* formed between the top plate 521 and the partition plate 523. Moreover, one end of the threaded rod 552 is connected to the adjusting member 551, and the other end of the threaded rod 552 is located in the accommodating space 523*a* of the case body 520. Therefore, when the adjusting member 551 is rotated, the threaded rod 552 rotates accordingly. The sliding block 553 is slidably disposed on the threaded rod 552, so that when the threaded rod 552 is rotated, the sliding block 553 can move along the threaded rod 552. In addition, one end of the connecting rod 554 is pivoted on the sliding block 553, and the other end of the connecting rod 554 is pivoted on the spherical shell 540. Therefore, when the sliding block 553 is moved, the connecting rod 554 moves the spherical shell 540 to swing along the second direction D6.

As shown in FIG. 19A, the spherical shell 540 is at the starting position, when the threaded rod 552 is rotated by the adjusting member 551, the sliding block 553 moves upwards along the threaded rod 552 accordingly. While the sliding block 553 is moving upwards, the connecting rod 554 moves the spherical shell 540 to swing along the second direction D6, so as to change the light emitting direction of the light source 560. In other embodiments, as shown in FIG. 17, the case body 520 further includes a window 520*b*. The position of the window 520*b* is corresponding to the position of the adjusting member 551, so that users can directly operate the adjusting member 551 from the outside of the case body 520 to change the light emitting direction of the light source 560. It is noted that, the rotation angle of the spherical shell 540 is related to the length or disposition position of the connecting rod 554 or the threaded rod 552 and the structure design of the spherical shell 540. Therefore, in other embodiments, the length or disposition position of the connecting rod 554 or the threaded rod 552 can be designed according to required rotation angles of the spherical shell 540, so as to meet practical requirements.

In the present embodiment, the rotary adjustment mechanism 530 and the inclination adjustment mechanism 550 are disposed inside the lamp 500. Moreover, the spherical shell 540 is partially disposed in the inner space 520*a* of the case body 520 and partially extends out of the opening 524. In addition, the light source 560 is disposed on the spherical shell 540 and is located outside the opening 524. When the spherical shell 540 or the case body 520 is rotated, the light emitting direction of the light source 560 changes accordingly but the exterior appearance of the lamp 500 is unchanged. Therefore, when multiple lamps 500 with different light emitting directions are applied in the same space, each lamp 500 has the same exterior appearance to make the visual effect in the space more organized.

According to the aforementioned embodiments of the present invention, the lamp of the present invention includes the rotary adjustment mechanism and the inclination adjustment mechanism, thereby enabling a user to rotate the case body relative to the lamp base or to rotate the spherical shell relative to the case body, thus changing a light emitting direction of the lamp to meet different illumination requirements. In addition, the rotary adjustment mechanism and the inclination adjustment mechanism are hidden internally, so that the exterior appearance of the lamp can be kept unchanged when the light emitting direction of the lamp is changed. Therefore, when multiple lamps with different light emitting directions are applied in the same space, each lamp has the same exterior appearance to make the visual effect in the space look more simple and organized.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A lamp, comprising:
a lamp base;
a case body;
a rotary adjustment mechanism;
an inclination adjustment mechanism; and
a light source which is rotatable along a first direction in a first plane by the rotary adjustment mechanism and/or rotatable along a second direction in a second plane by the inclination adjustment mechanism, wherein the second plane is different from the first plane;
wherein the rotary adjustment mechanism connects the lamp base and the case body, thereby enabling the case body to rotate relative to the lamp base along the first direction in the first plane;
wherein the lamp base comprises a bottom portion having a top surface and a bottom surface opposite to each other, and
wherein the rotary adjustment mechanism comprises:
a connecting member fixed on the case body
a positioning ring; and
a recess is disposed on the bottom surface of the bottom portion, wherein the positioning ring is disposed in the recess and abuts against the connecting member.

2. The lamp of claim 1, further comprising
a spherical shell, wherein the light source is disposed on the spherical shell; and
wherein the inclination adjustment mechanism connects the case body to the spherical shell, thereby enabling the spherical shell to rotate relative to the case body along the second direction in the second plane.

3. The lamp of claim 2, wherein the rotary adjustment mechanism comprises:
at least one first sliding chute passing through the bottom portion of the lamp base; and
at least one first fixing member moveably disposed through the first sliding chute and fixed on the case body.

4. The lamp of claim 3, wherein the case body has a top portion and at least one convex post extending from the top portion, and the first fixing member is fixed on the convex post.

5. The lamp of claim 3, wherein the inclination adjustment mechanism comprises:
at least one second sliding chute disposed at the case body;
at least one sliding member slidably disposed in the second sliding chute; and
at least one second fixing member which is correspondingly disposed through the sliding member and the second sliding chute and is fixed on the spherical shell.

6. The lamp of claim 5, wherein the sliding member is a resilient pad.

7. The lamp of claim 3, further comprising a positioning ring disposed between the lamp base and the case body.

8. The lamp of claim 2,
wherein the connecting member comprises a bottom base and a convex portion disposed on the bottom base, wherein the convex portion is disposed through the bottom portion of the lamp base and the bottom base abuts against the bottom surface of the bottom portion; and
a retaining ring disposed on the convex portion of the connecting member and abutting against the top surface of the bottom portion.

9. The lamp of claim 8, wherein
a sliding chute is disposed on the bottom surface of the bottom portion; and
the case body has a top portion and a convex post extending from the top portion, wherein the convex post is movably disposed in the sliding chute.

10. The lamp of claim 9, wherein a width of the sliding chute of the bottom surface is getting narrower to form a stopper on the bottom surface of the bottom portion.

11. The lamp of claim 8, wherein the spherical shell further comprises an inner space, and the inclination adjustment mechanism comprises:
a swing base disposed in the inner space and connected to the spherical shell;
a pivot mechanism connected to the swing base; and
a connecting stem, wherein one end of the connecting stem is pivoted on the swing base, and the other end of the connecting stem penetrates the spherical shell and is fixed on a top portion of the case body.

12. The lamp of claim 11, wherein
a groove is disposed on the case body; and
the inclination adjustment mechanism further comprises an adjusting member disposed through the groove from outside of the case body and connected to the spherical shell, so that the spherical shell is swingable relative to the connecting stem.

13. The lamp of claim 8, wherein the spherical shell comprises:

an upper spherical shell having at least one connecting post and at least one post opening;

a lower spherical shell having at least one supporting post corresponding to the connecting post; and at least one fixing member penetrating through the connecting post from the post opening of the upper spherical shell and fixed on the supporting post of the lower spherical shell.

14. A lamp, comprising:

a lamp base, a case body;

a rotary adjustment mechanism;

an inclination adjustment mechanism connecting the lamp base and the case body; and a light source which is rotatable along a first direction in a first plane by the rotary adjustment mechanism and/or rotatable along a second direction in a second plane by the inclination adjustment mechanism, wherein the second plane is different from the first plane;

wherein the rotary adjustment mechanism connects the lamp base and the case body, thereby enabling the case body to rotate relative to the lamp base along the first direction in the first plane;

wherein the lamp base comprises a bottom portion having a top surface, the case body comprises a top plate having a bottom surface, and the rotary adjustment mechanism comprises:

a connecting member fixed on the case body, wherein the connecting member comprises a bottom base and a convex portion disposed on the bottom base, wherein the convex portion penetrates through the top plate of the case body and the bottom portion of the lamp base, and the bottom base abuts against the bottom surface of the top plate; and a retaining ring disposed on the convex portion of the connecting member and abutting against the top surface of the lamp base.

15. The lamp of claim 14, wherein the bottom portion of the lamp base further comprises a bottom surface, wherein a sliding chute is disposed on the bottom surface of the bottom portion; and the case body has a convex post extending from the top plate of the case body, wherein the convex post is movably disposed in the sliding chute.

16. The lamp of claim 15, wherein a width of the sliding chute of the bottom surface is getting narrower to form a stopper on the bottom surface of the bottom portion.

17. The lamp of claim 15, wherein the rotary adjustment mechanism further comprises a positioning ring; and a recess is disposed on the bottom surface of the bottom portion, wherein the positioning ring is disposed in the recess and is mounted on the convex portion of the connecting member.

18. The lamp of claim 15, wherein the case body further comprises a partition plate, an accommodating space is formed between the partition plate and the top plate, wherein the inclination adjustment mechanism comprises:

an adjusting member disposed in the accommodating space;

a threaded rod connected to the adjusting member, wherein the adjusting member rotates with the threaded rod;

a sliding block slidably disposed on the threaded rod; and a connecting rod of which two ends respectively pivoted on the sliding block and the spherical shell.

19. The lamp of claim 18, wherein the case body further comprises a window, wherein the position of the window is corresponding to the position of the adjusting member.

* * * * *